US008644729B2

(12) United States Patent
Saito

(10) Patent No.: US 8,644,729 B2
(45) Date of Patent: Feb. 4, 2014

(54) IMAGE FORMING APPARATUS

(75) Inventor: Yasuhide Saito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 417 days.

(21) Appl. No.: 12/905,514

(22) Filed: Oct. 15, 2010

(65) Prior Publication Data

US 2011/0318059 A1 Dec. 29, 2011

(30) Foreign Application Priority Data

Jun. 25, 2010 (JP) ..... 2010-145510

(51) Int. Cl.
*G03G 15/00* (2006.01)

(52) U.S. Cl.
USPC ..... 399/111; 399/121; 399/167; 399/381

(58) Field of Classification Search
USPC ..... 399/111, 116, 117, 121, 167, 381, 388, 399/393, 394, 397, 399, 400, 107, 110
See application file for complete search history.

(56) References Cited

U.S. PATENT DOCUMENTS

| | | | | |
|---|---|---|---|---|
| 2008/0187368 | A1* | 8/2008 | Watanabe et al. | 399/286 |
| 2009/0263155 | A1* | 10/2009 | Murano | 399/107 |
| 2009/0274484 | A1* | 11/2009 | Takemoto | 399/107 |

FOREIGN PATENT DOCUMENTS

| | | | |
|---|---|---|---|
| EP | 0576758 | A2 | 1/1994 |
| JP | 63121062 | A | 5/1988 |
| JP | 6-19240 | A | 1/1994 |
| JP | 06194896 | A | 7/1994 |
| JP | 11-190924 | A | 7/1999 |
| JP | 2001347724 | A | 12/2001 |
| JP | 2008096879 | A | 4/2008 |

OTHER PUBLICATIONS

Japanese Office Action dated May 29, 2012 in counterpart Japanese Patent Application No. 2010-145510.

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

An image forming apparatus includes an image holding body unit having a first supported portion and an image holding body that is rotated while holding an image on a surface of the image holding body; and a conveying unit that is disposed below the image holding body unit and has conveying members for conveying a medium on which the image formed on the surface of the image holding body is to be recorded, image holding body support portions that supports both end portions, in an axial direction, of the image holding body, and a first support portion that supports the first supported portion.

18 Claims, 15 Drawing Sheets

IMAGE FORMING APPARATUS

CROSS-REFERENCE TO RELATED APPLICATIONS

This application is based on and claims priority under 35 USC 119 from Japanese Patent Application No. 2010-145510 filed on Jun. 25, 2010.

BACKGROUND

1. Technical Field

The present invention relates to an image forming apparatus.

SUMMARY

According to an aspect of the invention, there is provided an image forming apparatus comprising: an image holding body unit having a first supported portion and an image holding body which is rotated while holding an image on its surface; and a conveying unit which is disposed below the image holding body unit and has conveying members for conveying a medium on which the image formed on the surface of the image holding body is to be recorded, image holding body support portions which supports both end portions, in an axial direction, of the image holding body, and a first support portion which supports the first supported portion.

BRIEF DESCRIPTION OF THE DRAWINGS

Exemplary embodiments of the present invention will be described in detail based on the following figures, wherein:

FIG. 6A illustrate a state that U-shaped grooves are inserted in projections of the front fusing support portions, respectively, and FIG. 6B illustrate how fusing positioning portions of the rear fusing support portions are inserted into respective through-holes;

FIG. 12A shows a state that a conveying unit is attached to a frame, FIG. 12B shows a state, following the state of FIG. 12A, that a marking unit is attached to the frame, FIG. 12C shows a state, following the state of FIG. 12B, that a fusing unit is attached to the frame, and FIG. 12D shows a state, following the state of FIG. 12C, that a power device, a controller, and a cover are attached;

DESCRIPTION OF SYMBOLS

Figure 1:
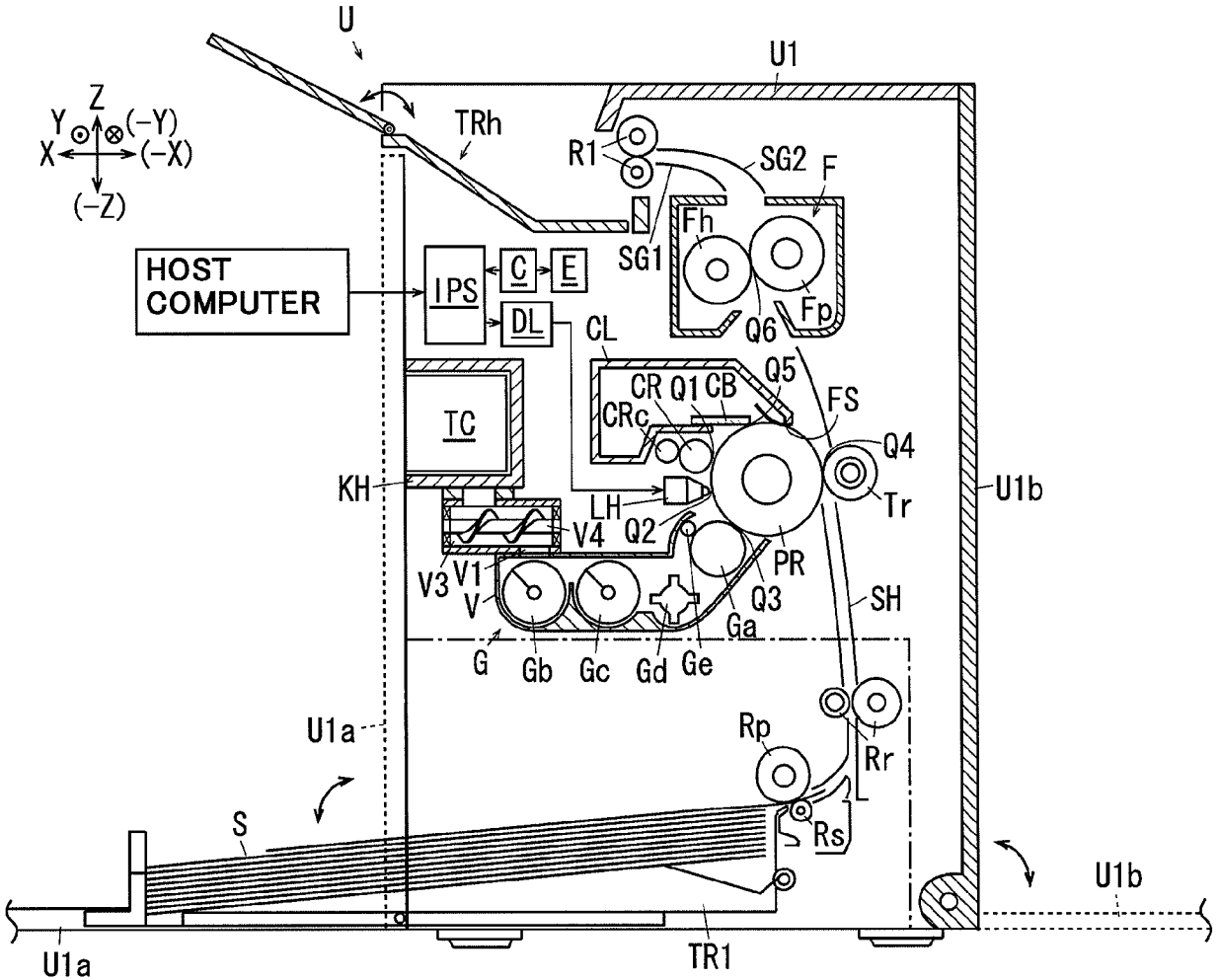
FIG. 1 shows the whole of a printer according to Example 1.

6, 7, 3*a*' . . . Image holding body support portions; 8, 9, 2*a*' . . . First support portion (s); 24' . . . Upper guide members; 26, 27, 22*a*' . . . First supported portion(s); (28-32), 4*a*' . . . Second support portion(s); 33, 34, 31' . . . Second supported portion(s); (38+39*h*) . . . Link portions; (41-47) . . . Drive transmission system; 48 . . . Drive source; 51 . . . Circuit support body; 51*a* . . . Power source support portion; 51*c* . . . Control section support portion; 51*j* . . . Positioning portion; C . . . Control section; E . . . Power source; F, F' . . . Fusing device; PR, PR' . . . Image holding body; Q4, Q4' . . . Transfer region; Rr, Rr' . . . Conveying members; S . . . Medium; (TB+24') . . . Guide members; TB . . . Lower guide member; Tr, Tr' . . . Transfer device; U, U' . . . Image forming device; U2, U2' . . . Conveying unit; U3, U3' . . . Image holding body unit; U4, U4' . . . Fusing unit; U5 . . . Drive transmitting unit.

DETAILED DESCRIPTION

Specific examples (hereinafter called Examples) of an exemplary embodiment of the present invention will be hereinafter described with reference to the drawings. However, the invention is not limited to those Examples.

To facilitate understanding of the following description, in the drawings, the X-axis direction, the Y-axis direction, and the Z-axis direction are defined as the front-rear direction, the right-left direction, and the top-bottom direction, respectively, and the directions or sides indicated by arrows X, −X, Y, −Y, and Z, and −Z are defined as the front direction or side, the rear direction or side, the right direction or side, the left direction or side, the top direction or side, and the bottom direction or side, respectively.

In the drawings, a circle "o" having a dot "•" inside means an arrow that is directed from the back side to the front side of the paper surface and a circle "o" having a cross "x" inside means an arrow that is directed from the front side to the back side of the paper surface.

Furthermore, in the drawings, to facilitate understanding, members etc. that are not indispensable for a description may be omitted as appropriate.

Example 1

FIG. 1 shows the whole of a printer U according to Example 1. As shown in FIG. 1, in the printer U (example image forming apparatus) according to Example 1 of the invention, a front cover U1*a* (example opening/closing member) which can be opened and closed with its bottom end as a center of rotation in inserting and housing sheets S (example media) is supported by a front wall of a printer main body U1 (example image forming apparatus main body). A top wall of the printer U is formed with an ejected sheet tray TRh (example ejected sheet storage unit) to which sheets S on which images are recorded are ejected. Furthermore, a back cover U1*b* (example opening/closing member) which exposes the inside of the printer main body U1 in the event of a sheet jam, or in inspecting the inside or doing like work is supported by a rear wall of the printer main body U1 so as to be rotatable between a closed position indicated by a solid line and an open position indicated by a broken line.

The printer U according to Example 1 is equipped with a controller C (example control section), an image processing system IPS whose operation is controlled by the controller C, a laser drive circuit DL (example image writing circuit), a power device E, etc. The power device E supplies voltages to a charging roll CR (example charger), a developing roller Ga (example developing member), a transfer roll Tr (example transfer device), etc. all of which will be described later.

The image processing system IPS converts print information supplied from a host computer (example external information transmitting apparatus) or the like into image information for latent image formation and outputs the image information to the laser drive circuit DL with preset timing. The laser drive circuit DL outputs a drive signal to a latent image forming device LH on the basis of the received image information. In Example 1, the latent image forming device LH is a device (LED head) in which LEDs (light-emitting diodes; example latent image writing elements) are arranged in the right-left direction at prescribed intervals.

A photoreceptor body PR (example image holding body) which is driven rotationally is supported so as to be disposed at a rear position in the printer U. The charging roll CR, the latent image forming device LH, a developing device G, the transfer roll Tr, and a photoreceptor body cleaner CL (example cleaner for the image holding body) are disposed around the photoreceptor body PR in this order in the rotation direction of the photoreceptor body PR.

As shown in FIG. 1, a charging roll cleaner CRc (example cleaner for the charger) for cleaning the surface of the charging roll CR is opposed to the charging roll CR so as to be in contact with the latter.

The developing device G has a development container V which contains a developer inside. The developing roll Ga which is opposed to the photoreceptor body PR, a pair of circulatory transport members Gb and Gc for transporting developer in circulation while stirring it, a supply member Gd for transporting developer that has been stirred by the circulatory transport members Gb and Gc, and a layer thickness limiting member Ge are arranged in the development container V.

A front portion of the top wall of the development container V is formed with a developer supply hole V1 (example supply portion), and a developer supply passage V3 (example developer transport passage) which extends forward is connected to the developer supply hole V1. A supply auger V4 (example developer transport member) is rotatably supported inside the developer supply passage V3. A cartridge holder KH (example attachment/detachment unit) to or from which a toner cartridge TC (example developer container) is to be attached or detached is connected to a front portion of the developer supply passage V3, and developer flows into the developer supply passage V3 from the toner cartridge TC. Therefore, developer is supplied to the developing device G from the toner cartridge TC as the supply auger V4 is driven according to a developer consumption amount in the developing device G.

The surface of the rotating photoreceptor body PR us charged by the charging roll CR at a charging region Q1, and an electrostatic latent image is formed at a latent image forming position Q2 by latent image forming light which is emitted from the latent image forming device LH. The electrostatic latent image is developed into a toner image (example image, example visible image) by the developing roll Ga at a developing region Q3. The toner image formed on the photoreceptor body PR is transferred to a sheet S (example medium) by the transfer roll Tr at a transfer region Q4 where the photoreceptor body PR (example rotary member) and the transfer roll Tr (example counter member) are opposed to each other. In Example 1, the transfer roll Tr is made of an elastic material and can be deformed elastically when brought into contact with the photoreceptor body PR.

Residual toner on the surface of the photoreceptor body PR is removed by a cleaning blade CB (example cleaning member) at a cleaning region Q5 (example cleaning region) located downstream of the transfer region Q4 and collected into the photoreceptor body cleaner CL.

A film sheet FS (example scattering preventing member) is disposed on the side where the cleaning blade CB is opposed to the photoreceptor body PR. The film sheet FS prevents toner that has been collected into the photoreceptor body cleaner CL from dropping out.

As shown in FIG. 1, the sheet supply tray TR1 which is disposed at the bottom of the printer U is provided with a pickup roll Rp (example medium pickup member). Recording sheets S that are picked up by the pickup roll Rp are separated into individual sheets S by a retard roll Rs (example medium separating member), and each recording sheet S is conveyed to the transfer region Q4 with preset timing by registration rolls Rr (example timing adjusting members, example conveying members) which are disposed upstream of the transfer region Q4 in the sheet conveyance direction.

The transfer roll Tr to which a transfer voltage is applied from, for example, the power device E whose operation is controlled by the controller C transfers a toner image formed on the photoreceptor body PR to a recording sheet S that is passing the transfer region Q4.

The recording sheet S to which the toner image has been transferred at the transfer region Q4 is conveyed to a fusing device F with the toner image not fused yet. The fusing device F has a pair of fusing rolls Fh and Fp (example fusing members), and a fusing region Q6 is formed as a pressure contact region of the fusing rolls Fh and Fp. The toner image formed on the recording sheet S that has been conveyed to the fusing device F is fused by the fusing rolls Fh and Fp at the fusing region Q6. The recording sheet S bearing the fused toner image is conveyed being guided by sheet guides SG1 and SG2 (example medium guiding members) and ejected to the ejected sheet tray TRh which constitutes part of the top wall of the printer main body U1 through sheet ejecting rolls R1 (example medium ejecting members). Therefore, in Example 1, a sheet S is conveyed upward from the right end of the sheet supply tray TR1 which is disposed at the bottom of the printer main body U1 past the members Rp, Rs, Rr, PR, Tr, F, and R1, and is ejected to the ejected sheet tray Rh from its right end. That is, as shown in FIG. 1, the printer U according to Example 1 is configured in such a manner that the conveyance path of a sheet S has an inverted-C shape (the conveyance path is what is called a C path).

(Conveying Unit U2 of Example 1)

Figure 2:
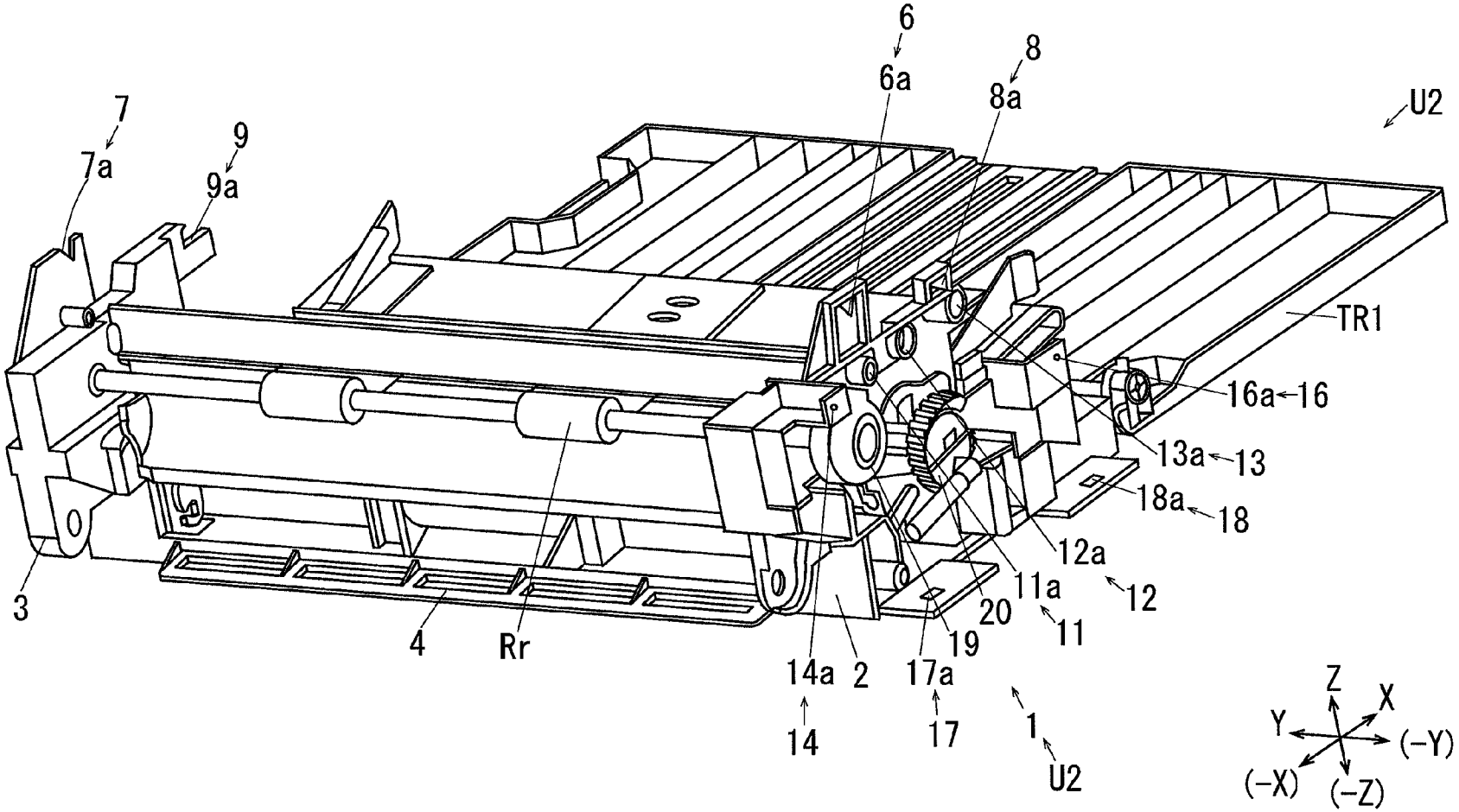
FIG. 2 is an enlarged perspective view of a conveying unit of Example 1.

FIG. 2 is an enlarged perspective view of a conveying unit U2 of Example 1. As indicated by a chain line in FIG. 1, the conveying unit U2 which supports the sheet supply tray TR1, the pickup roll Rp, the separating roll Rs, the registration rolls Rr, etc. occupies a bottom space of the printer main body U1. As shown in FIG. 2, the conveying unit U2 has a conveyance housing 1 (example conveyance support body) which supports the members TR1, Rp, Rs, and Rr. In the conveyance housing 1 of Example 1, a left end wall 2 and a right end wall 3 which are located at the left end and the right end in the axial direction of the rolls Rp, Rs, and Rr and a bottom wall 4 which connect the left end wall 2 and the right end wall 3 at bottom-rear positions are integrated together.

A pair of (left and right) photoreceptor body support portions 6 and 7 (example image holding body support portions) are formed so as to project upward from top-rear portions of the left end wall 2 and the right end wall 3, respectively. In Example 1, a top portion of the left photoreceptor body support portion 6 is formed with a triangular through-hole 6*a* having an apex at the bottom, and a top portion of the right photoreceptor body support portion 7 is formed with a V-shaped groove 7*a*.

Marking support portions 8 and 9 (example first support portions) which project upward and opposed to each other in the right-left direction are formed in front of the respective photoreceptor body support portions 6 and 7. A rectangular through-hole 8*a* penetrates through the left marking support portion 8 in the right-left direction. The right marking support portion 9 is shaped in such a manner that its bottom portion extends forward more than its top portion, and a groove 9*a* which extends in the front-rear direction is formed between the top portion and the bottom portion.

Shaft support portions 11, 12, and 13 which project leftward are disposed below the left photoreceptor body support portion 6 and the left marking support portion 8 so as to be spaced from each other in the front-rear direction. The shaft support portions 11, 12, and 13 are formed with respective bearing portions 11*a*, 12*a*, and 13*a* which are recessed rightward. A first link support portion 14 which projects leftward from the left end wall 2 is formed behind the rear shaft support portion 11, and a first link threaded hole 14*a* is formed in a left end wall of the first link support portion 14. A second link support portion 16 which projects leftward from the left end wall 2 is formed at a bottom-front position with respect to the front shaft support portion 13, and a second link threaded hole 16*a* is formed in a left end wall of the second link support portion 16.

A flat-plate-like third link support portion 17 and fourth link support portion 18 extend leftward from bottom portions of the left end wall 2 (from vertical positions spaced from the bottom surface of the left end wall 2) so as to be spaced from each other in the front-rear direction. Nail fixing holes 17*a* and 18*a* penetrate through the respective link support portions 17 and 18 in the top-bottom direction. A pickup gear 19 (example pickup drive transmission member) which is supported by a left end portion of a rotary shaft of the pickup roll Rp and a conveying gear 20 (example conveyance drive transmission member) which is supported by a left end portion of a rotary shaft of one of the registration rolls Rr are disposed below the shaft support portions 11, 12, and 13.

(Marking Unit U3 of Example 1)

Figure 3:
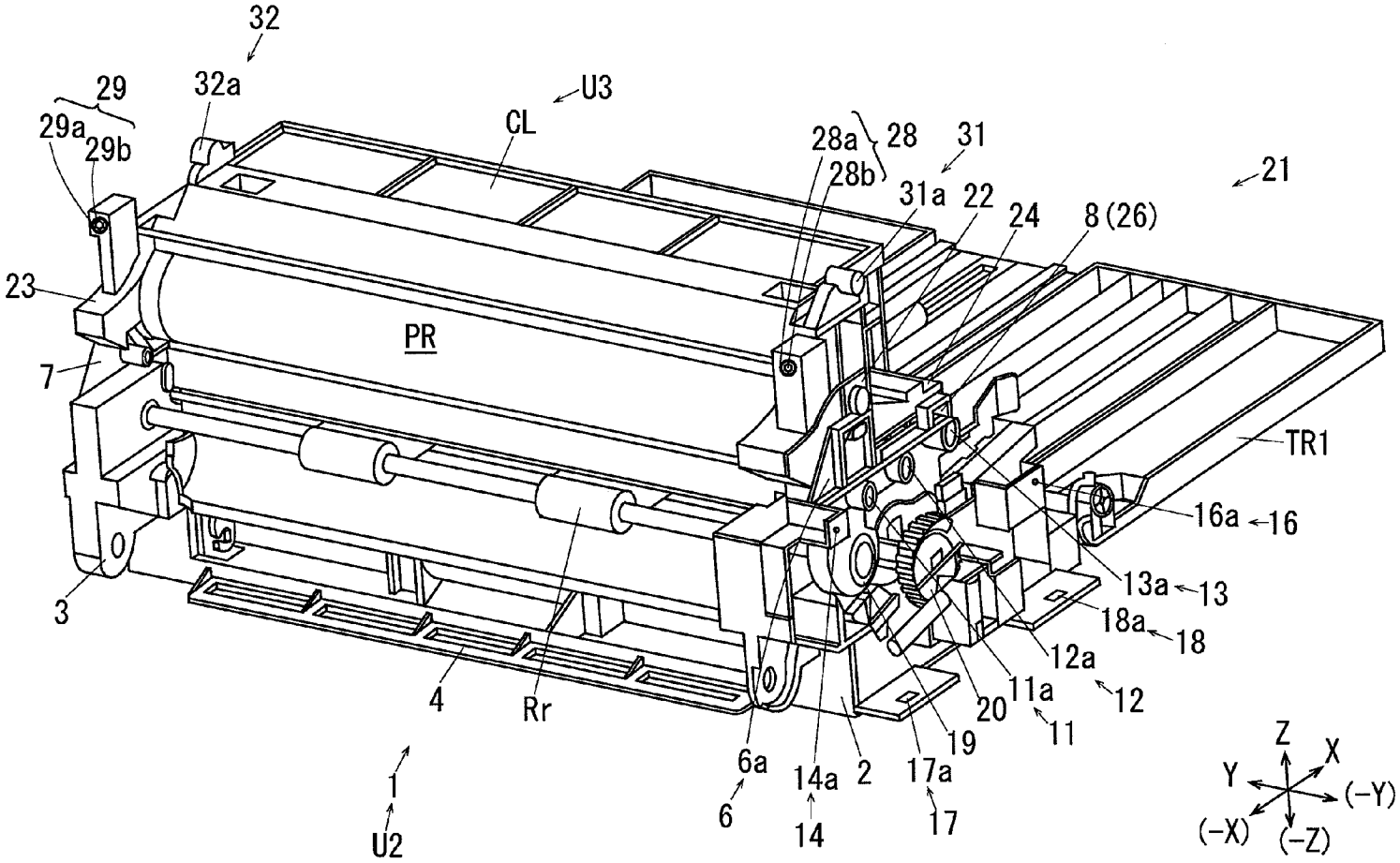
FIG. 3 is an enlarged perspective view of a marking unit of Example 1 in a state that it is mounted on the conveying unit.
Figure 4:
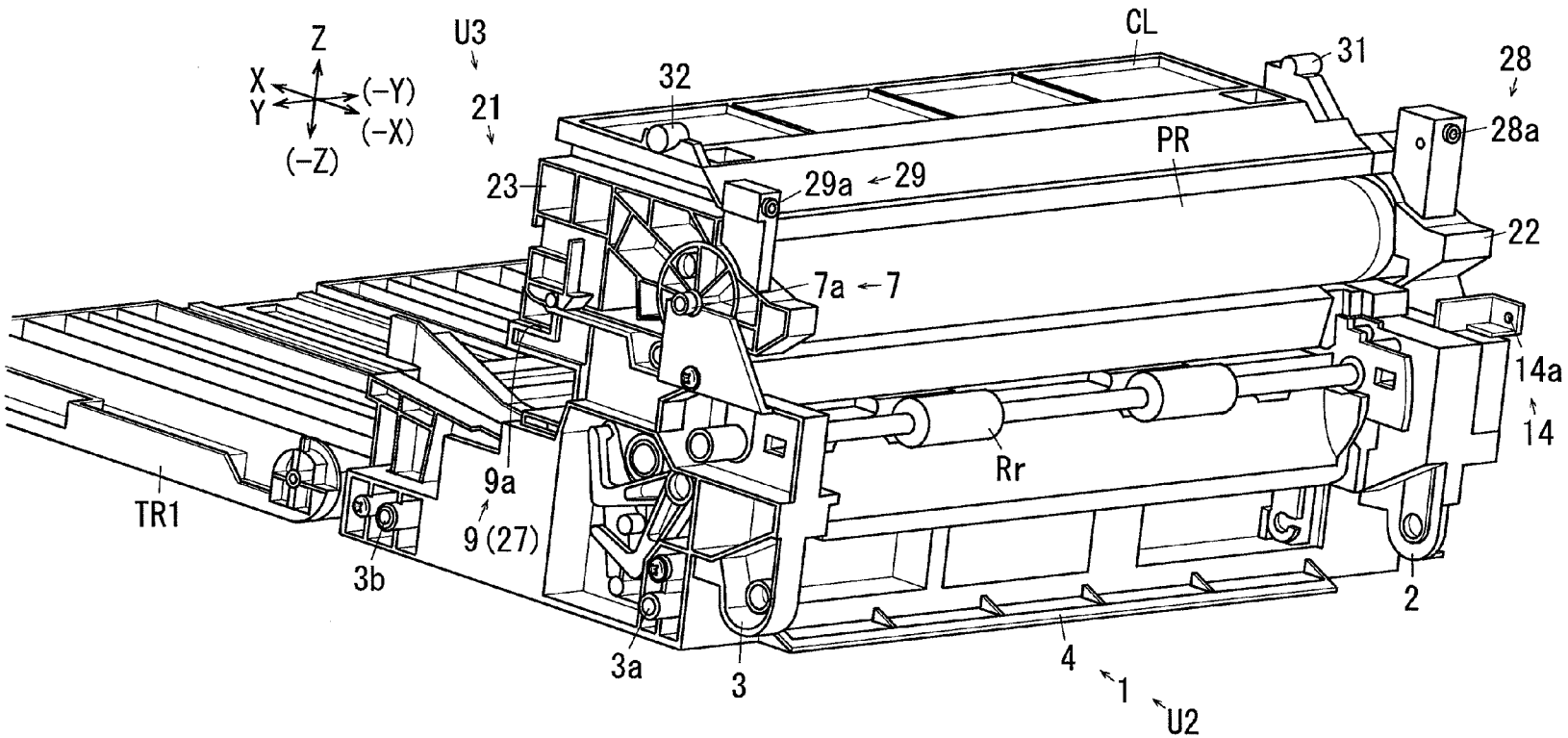
FIG. 4 is an enlarged perspective view of the marking unit as viewed from the direction of arrow IV in FIG. 3.

FIG. 3 is an enlarged perspective view of a marking unit U3 of Example 1 in a state that it is mounted on the conveying unit U2. FIG. 4 is an enlarged perspective view of the marking unit U3 as viewed from the direction of arrow IV in FIG. 3.

The marking unit U3 (example image holding body unit) which supports the photoreceptor body PR, the photoreceptor body cleaner CL, the charging roll CR, the charging roll cleaner CRc, the latent image forming device LH, the developing device G, etc. is disposed over and supported by the conveying unit U2. As shown in FIGS. 3 and 4, the marking unit U3 has a marking housing 21 (example image holding body support body) which supports the members PR, CL, CR, CRc, LH, and G. In the marking housing 21 of Example 1, a left end wall 22 and a right end wall 23 and a bottom wall 24 as a portion connecting the left end wall 22 and the right end wall 23 are integrated together.

A front left-end portion and a front right-end portion of the bottom wall 24 are formed with marking supported portions 26 and 27 (example first supported portions) which project leftward and rightward, respectively.

In Example 1, a left end portion of a shaft member of the photoreceptor body PR penetrates through the through-hole 6*a* and is thereby supported by the left photoreceptor body support portion 6 so as not to be disengaged upward. A right end portion of the shaft member of the photoreceptor body PR is supported by the right photoreceptor body support portion 7 so as to be positioned being fitted in the groove 7*a*. The left marking supported portion 26 penetrates through the through hole 8*a* and is thereby supported by the left marking support portion 8 so as not to be disengaged upward. The right marking supported portion 27 is supported by the right marking support portion 9 so as to be positioned being fitted in the groove 9*a*. In Example 1, a top portion of the right marking supported portion 27 is formed with a projection 27*a* which projects over the groove 9*a*.

That is, in Example 1, the marking support portions 8 and 9 support the marking supported portions 26 and 27 and thereby prevent the marking unit U3 (in which the photoreceptor body PR is supported by the photoreceptor body support portions 6 and 7) from rotating with the shaft member of the photoreceptor body PR as a center of rotation. As a result, the marking unit U3 is supported by the conveying unit U2 so as to be positioned over the conveying unit U2.

A pair of (left and right) rear fusing support portions 28 and 29 project upward from top-rear portions of the left end wall 22 and the right end wall 23, respectively. In Example 1, top portions of the rear fusing support portions 28 and 29 are formed with respective cylindrical fusing positioning portions 28*a* and 29*a* which project rearward from their rear ends. The fusing positioning portions 28*a* and 29*a* are formed with threaded holes 28*b* and 29*b* which extend forward from their rear ends.

A pair of (left and right) front fusing support portions 31 and 32 which project upward are formed in front of the respective rear fusing support portions 28 and 29. In Example 1, cylindrical projections 31*a* and 32*a* project outward (in the right-left direction) from top portions of the front fusing support portions 31 and 32, respectively.

The rear fusing support portions 28 and 29 and the front fusing support portions 31 and 32 constitute fusing support portions (28-32) (example second support portions).

(Fusing Unit U4 of Example 1)

Figure 5A:
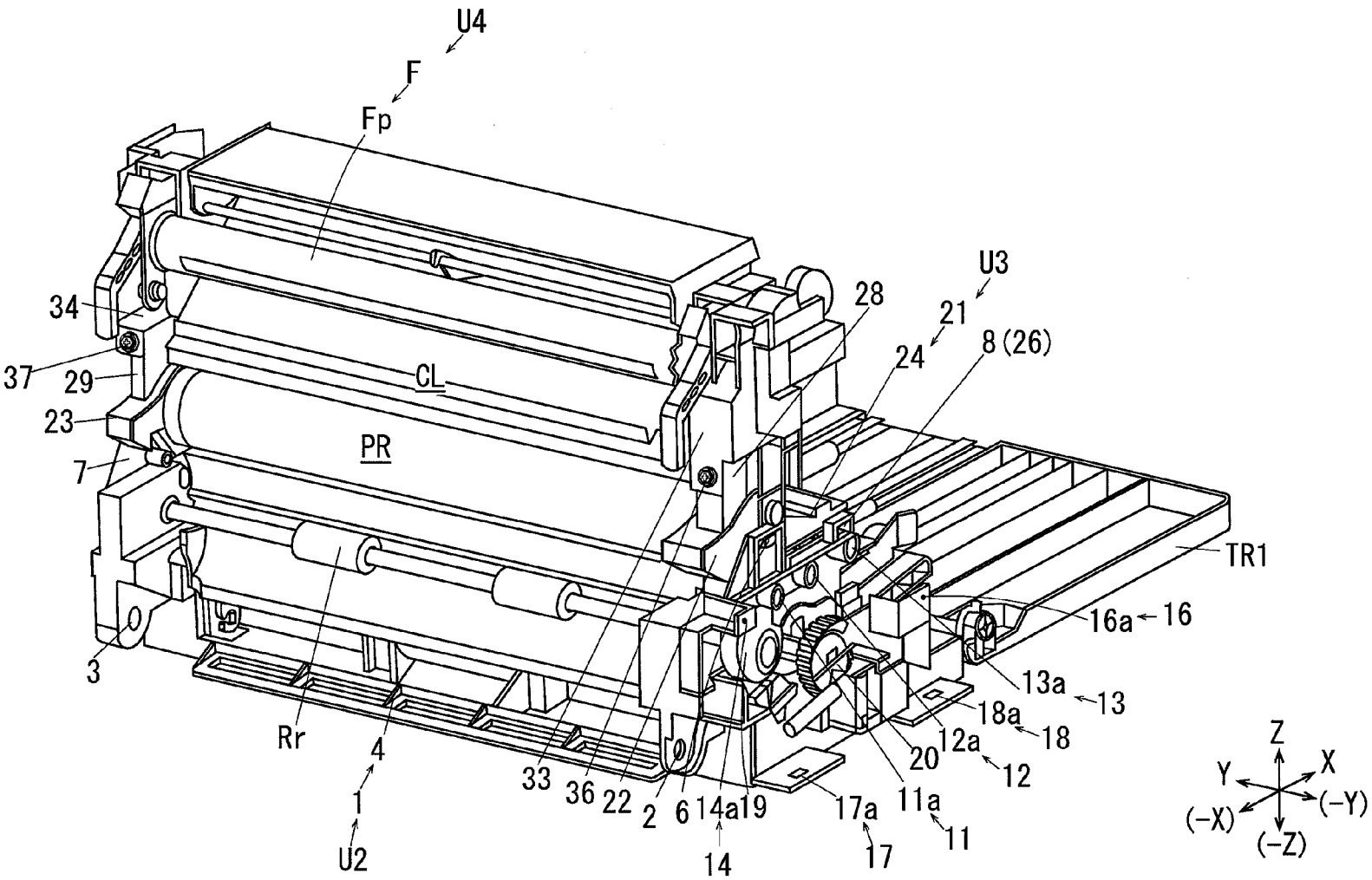
FIG. 5A is an enlarged perspective view of a fusing unit of Example 1 in a state that it is mounted on the marking unit.
Figure 5B:
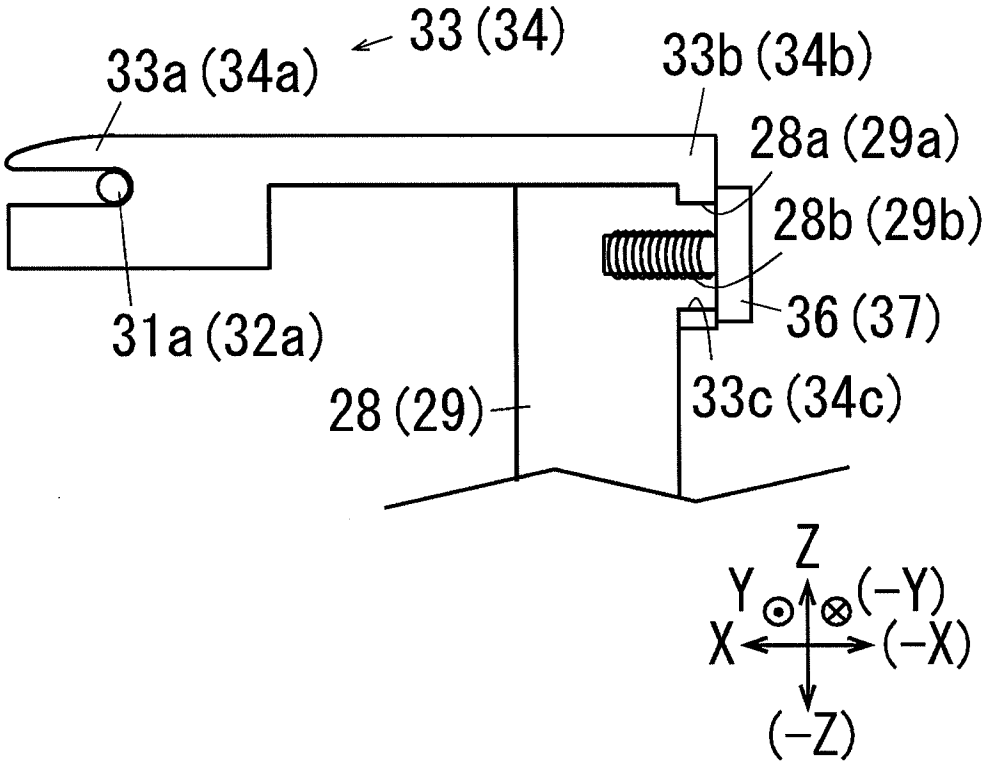
FIG. 5B is a sectional view of fusing supported portions being supported by respective fusing support portions of the marking unit.

FIG. 5A is an enlarged perspective view of a fusing unit U4 of Example 1 in a state that it is mounted on the marking unit U3, and FIG. 5B is a sectional view of fusing supported portions being supported by the respective fusing support portions 28-32 of the marking unit U3.

The fusing unit U4 is disposed over and supported by the marking unit U3. As shown in FIG. 5A, the fusing unit U4 has the above-described fusing device F and fusing supported portions 33 and 34 (example second supported portions) which are bottom portions of left and right end walls of the fusing device F.

As shown in FIG. 5B, front end portions of the fusing supported portions 33 and 34 are formed with U-shaped grooves 33*a* and 34*a* which extend in the front-rear direction and serve to position the projections 31*a* and 32*a* in the top-bottom direction, respectively. In Example 1, rear end portions of the fusing supported portions 33 and 34 are formed with plate-like fusing positioned portions 33*b* and 34*b* which extend downward so as to be opposed to the rear surfaces of the rear fusing support portions 28 and 29, respectively. The fusing positioned portions 33*b* and 34*b* are formed with through-holes 33*c* and 34*c* whose diameters are the same as the outer diameter of the fusing positioning portions 28*a* and 29*a* at such positions that they correspond to the fusing positioning portions 28*a* and 29*a*, respectively.

In Example 1, the outer diameter of screw heads 36*a* and 37*a* of screws 36 and 37 is larger than that of the fusing positioning portions 28*a* and 29*a*, that is, the diameter of the through-holes 33*c* and 34*c*. That is, in Example 1, the screw heads 36*a* and 37*a* prevent the fusing positioned portions 33*b* and 34*b* (through whose through-holes 33*c* and 34*c* the fusing positioning portions 28*a* and 29*a* penetrate) from coming off rearward.

Figure 6A:
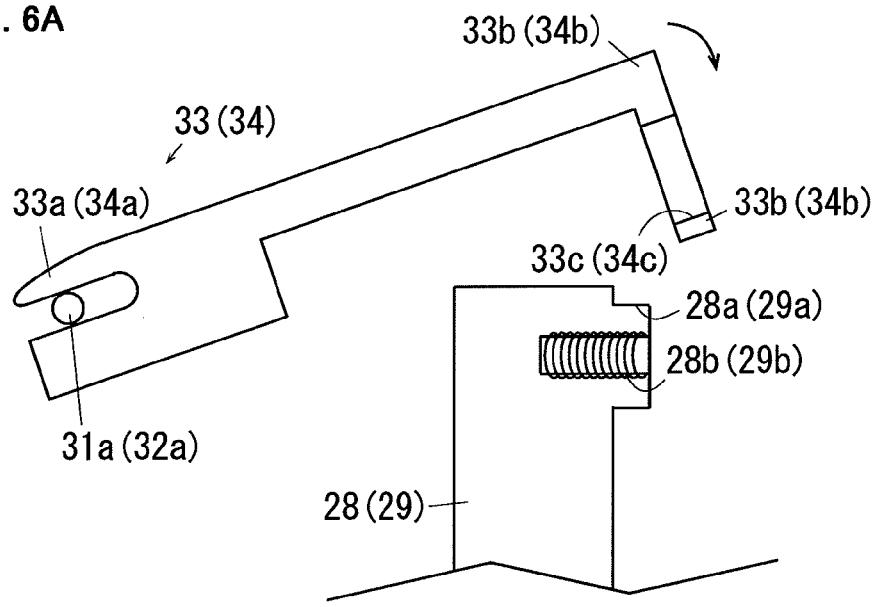
FIGS. 6A and 6B illustrate how the fusing supported portions of the fusing unit of Example 1 are attached to the fusing support portions of the marking unit.
Figure 6A:
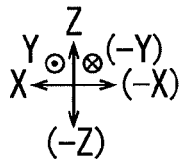
Figure 6B:
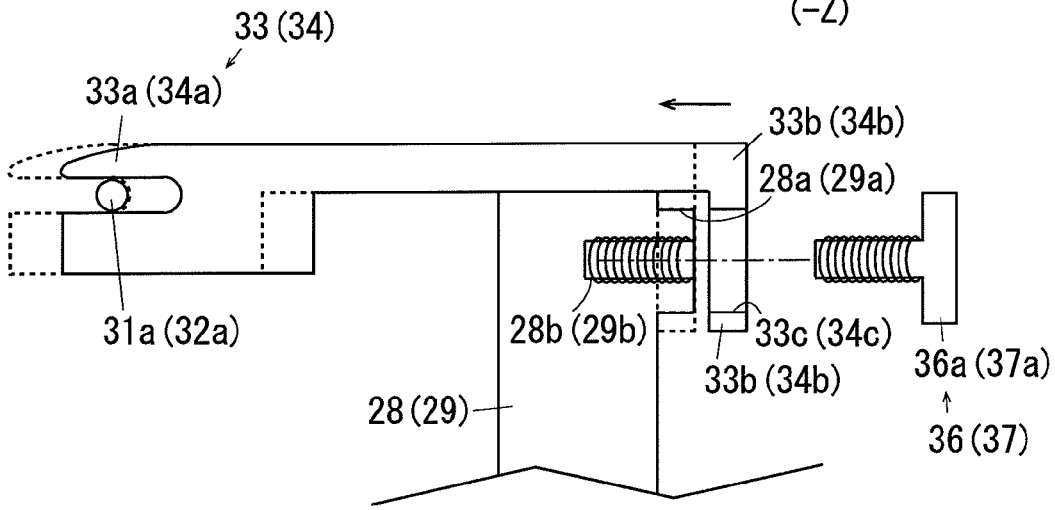

FIGS. 6A and 6B illustrate how the fusing supported portions 33 and 34 of the fusing unit U4 of Example 1 are attached to the fusing support portions 28-32 of the marking unit U3. FIG. 6A illustrate a state that the U-shaped grooves 33*a* and 34*a* are inserted in the projections 31*a* and 32*a* of the front fusing support portions 31 and 32, respectively, and FIG. 6B illustrate how the fusing positioning portions 28*a* and 29*a* of the rear fusing support portions 28 and 29 are inserted into the respective through-holes 33*c* and 34*c*.

In Example 1, first, as shown in FIG. 6A, after the projections 31*a* and 32*a* are inserted in the U-shaped grooves 33*a* and 34*a*, the rear sides of the fusing supported portions 33 and 34 which are guided through their U-shaped grooves 33*a* and 34*a* are rotated downward with the projections 31*a* and 32*a* as centers of rotation. Then, as indicated by broken lines in FIG. 6B, the fusing supported portions 33 and 34 are slid forward and the rear fusing support portions 28 and 29 are inserted into the respective through-holes 33*c* and 34*c*, whereby positioning is done. Then, the screws 36 and 37 are screwed into the respective threaded holes 28*b* and 29*b*, whereby the fusing positioned portions 33*b* and 34*b* are prevented from coming off and the fusing supported portions 33 and 34 are fixed to and supported by the fusing support portions 28-32. As a result, as indicated by solid lines in FIG. 6B, the rear end portions of the fusing supported portions 33 and 34 are supported by the top surfaces of the rear fusing support portions 28 and 29, respectively.

(Drive Transmitting Unit U5 of Example 1)

Figure 7:
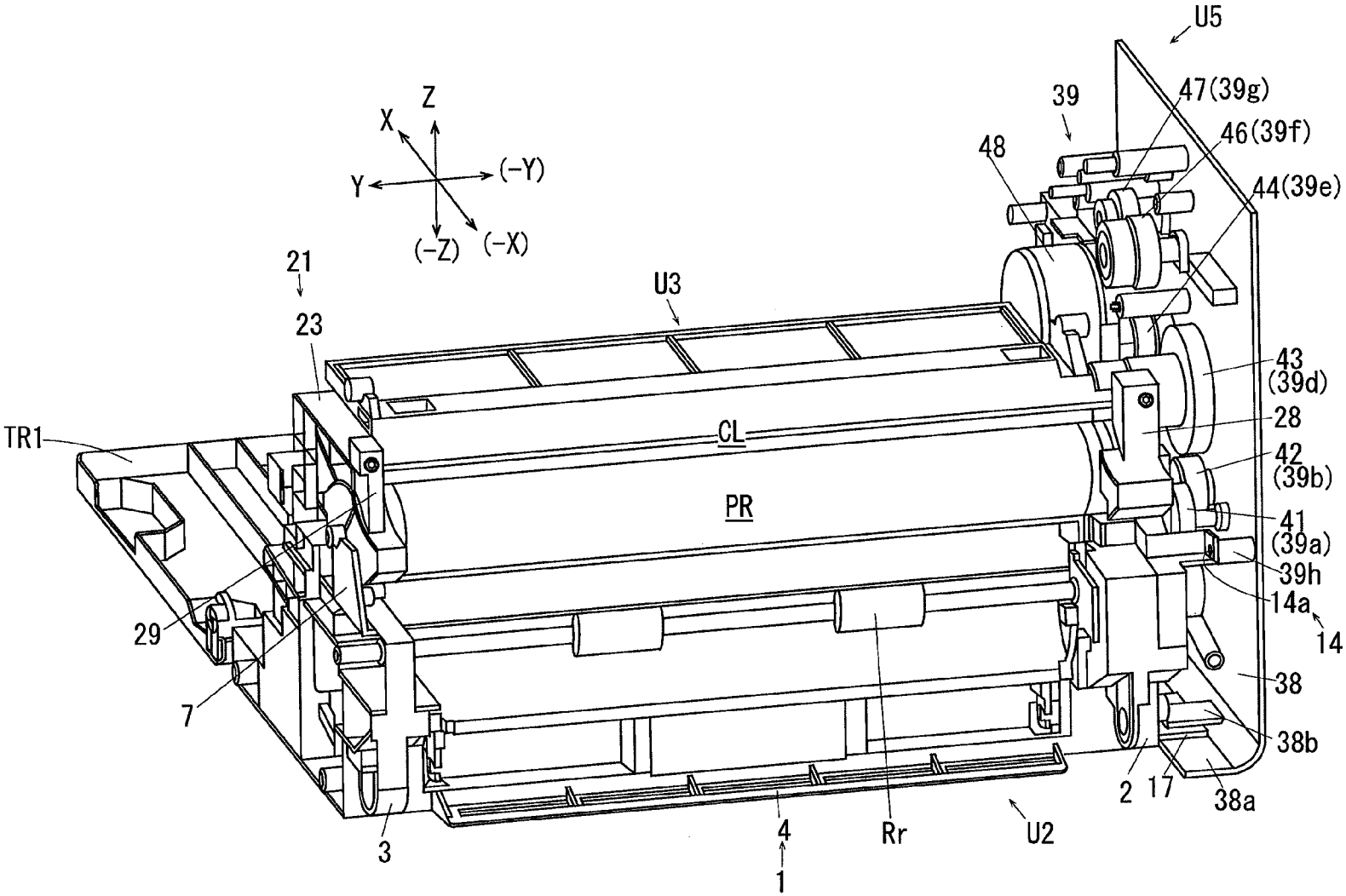
FIG. 7 is an enlarged perspective view of a drive transmitting unit of Example 1 in a state that is attached to the conveying unit and the marking unit.
Figure 8:
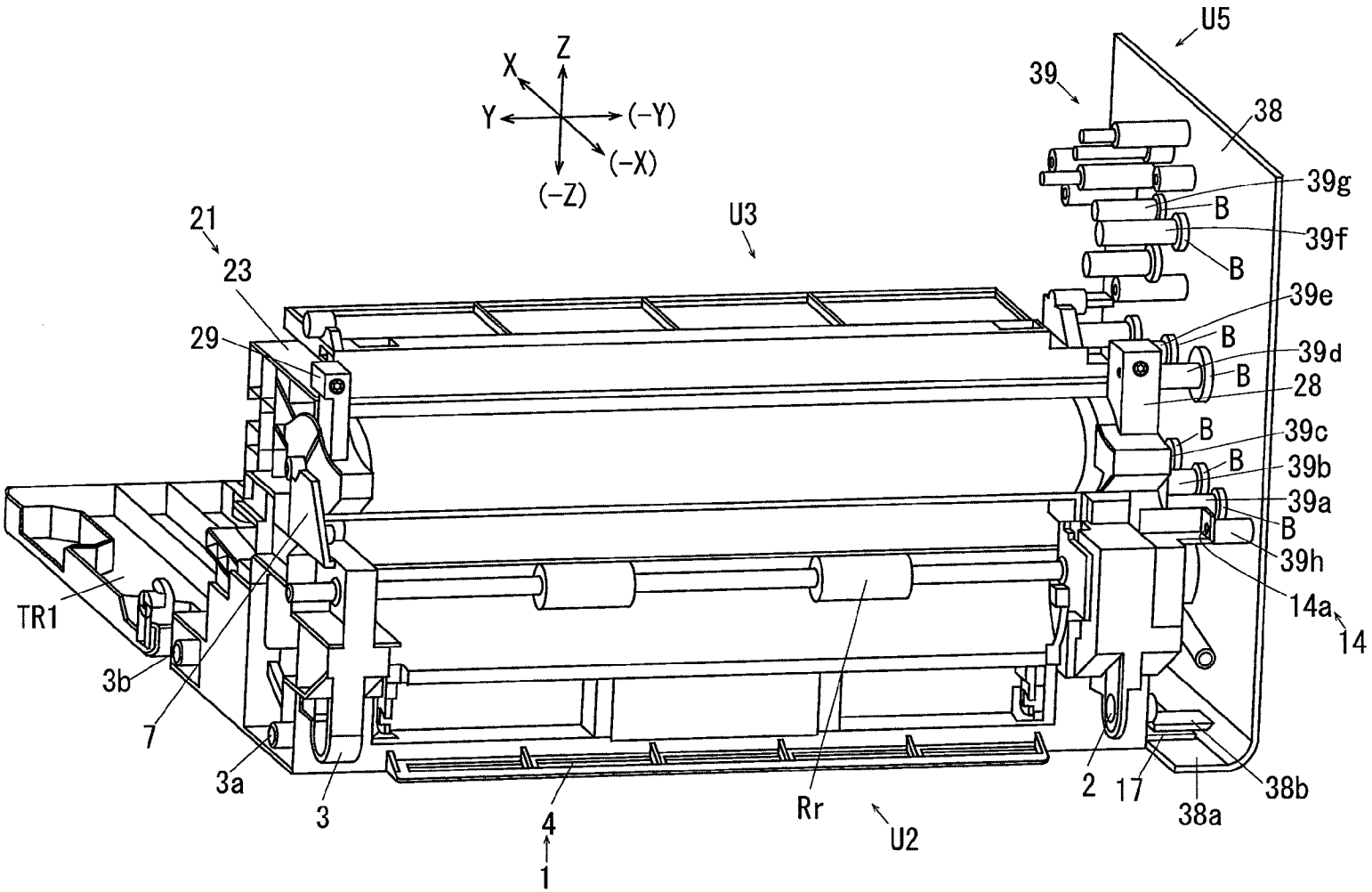
FIG. 8 shows link portions of the drive transmitting unit in such a manner that a main motor and all gears are removed from FIG. 7.

FIG. 7 is an enlarged perspective view of a drive transmitting unit U5 of Example 1 in a state that is attached to the conveying unit U2 and the marking unit U3. FIG. 8 shows link portions of the drive transmitting unit U5 in such a manner that a main motor and all gears are removed from FIG. 7.

The drive transmitting unit U5 is disposed on the left of and supported by the units U2-U4. As shown in FIG. 7, the drive transmitting unit U5 of Example 1 is disposed on the left of the units U2-U4 and has a plate-like link plate 38 which fully covers the left sides of the units U2-U4 and shafts 39 (example shaft members) which project from the right surface of the link plate 38 rightward, that is, toward the units U2-U4. The shafts 39 of Example 1 is produced by gas injection molding so as not to project leftward from the link plate 38.

As shown in FIGS. 7 and 8, the link plate 38 of Example 1 has a bottom wall 38*a* which is bent rightward, i.e., toward the conveying unit U2. And two flat-plate-like link supported portions 38*b* which extend rightward are formed above the bottom wall 38*a* at such positions as to correspond to the respective link support portions 17 and 18 of the conveying unit U2 so as to be spaced from each other in the front-rear direction. The bottom surfaces of the two link supported portions 38*b* of Example 1 are formed with nails (not shown) which are fitted in the nail fixing holes 17*a* and 18*a* of the link support portions 17 and 18 and thereby fixed to the link support portions 17 and 18, respectively.

As shown in FIG. 8, the shafts 39 of Example 1 include a first conveyance gear shaft 39*a*, a second conveyance gear shaft 39*b*, and a third conveyance gear shaft 39*c* which are disposed at such positions as to correspond to the respective shaft support portions 11, 12, and 13 of the conveying unit U2 and which are supported rotatably by respective bearings B supported by the link plate 38. A first marking gear shaft 39*d* and a second marking gear shaft 39*e* which are supported rotatably by respective bearings B are disposed above the conveyance gear shafts 39*a*-39*c* at such positions as to correspond to the photoreceptor body PR and the developing device G of the marking unit U3, respectively.

A first fusing gear shaft 39*f* and a second fusing gear shaft 39*g* which are supported rotatably by respective bearings B are disposed above the marking gear shafts 39*d* and 39*e* at such positions as to correspond to the fusing device F of the fusing unit U4. A first link shaft 39*h* is disposed at such a position as to corresponding to the first link threaded hole 14*a* of the first link support portion 14. A second link shaft (not shown) is disposed at such a position as to corresponding to the second link threaded hole 16*a* of the second link support portion 16.

The link plate 38, the first link shaft 39*h*, the second link shaft, etc. constitute link portions (38+39*h*) of Example 1.

As shown in FIG. 7, a first conveyance drive gear 41 and a second conveyance drive gear 42 (an example conveyance drive transmission system) which engage with the respective gears 19 and 20 provided in the conveying unit U2 are supported by the respective conveyance gear shafts 39*a* and 39*b*. A first marking drive gear 43 and a second marking drive gear 44 (an example image holding body drive transmission system) which engage with marking drive subject gears (an example image holding body drive subject transmission system; not shown) provided in the marking unit U3 are supported by the respective marking gear shafts 39*d* and 39*e*. Furthermore, a first fusing drive gear 46 and a second fusing drive gear 47 (an example fusing drive transmission system) which engage with fusing drive subject gears (an example fusing drive subject transmission system; not shown) provided in the fusing unit U4 are supported by the respective fusing gear shafts 39*f* and 39*g*.

A main motor 48 (example drive source) which generates drive power disposed at a front-center position of the right surface of the link plate 38 and is supported by the link plate 38. The printer U according to Example 1 is designed so that drive power is transmitted from the main motor 48 to the drive gears 41-47 via other drive gears (example gear members; not shown).

The conveyance drive gears 41 and 42, the marking drive gears 43 and 44, the fusing drive gears 46 and 47, and the other drive gears constitute a drive transmission system (41-47) of Example 1.

The drive transmitting unit U5 of Example 1 is supported by the conveying unit U2 by bringing the first link shaft 39*h* and the second link shaft opposed to the respective link threaded holes 14*a* and 16*a* and fixing the first link shaft 39*h* and the second link shaft to the first link support portion 14 and the second link support portion 16, respectively, by screwing screws (not shown) into the link threaded holes 14*a* and 16*a* in a state that the nails of the two link supported portions 38*b* are fitted in the nail fixing holes 17*a* and 18*a* of the link support portions 17 and 18, respectively. As a result, the link portions (38+39*h*) are connected to the conveying unit U2 and the drive transmitting unit U5 is attached to the units U2-U4. At this time, the conveyance gear shafts 39*a*, 39*b*, and 39*c* are inserted into the bearing portions 11*a*, 12*a*, and 13*a* of the shaft support portions 11, 12, and 13, respectively, whereby the conveyance drive gears 41 and 42 are supported rotatably being held on both sides. At this time, the drive gears 41-47 of the drive transmitting unit U5 are engaged with the drive subject gears 19 and 20 and the other ones. Therefore, drive power is transmitted from the main motor 48 to the individual members of the units U2-U4 via the gears 19, 20, and 41-47 and the other gears.

(Circuit Unit U6 of Example 1)

Figure 9:
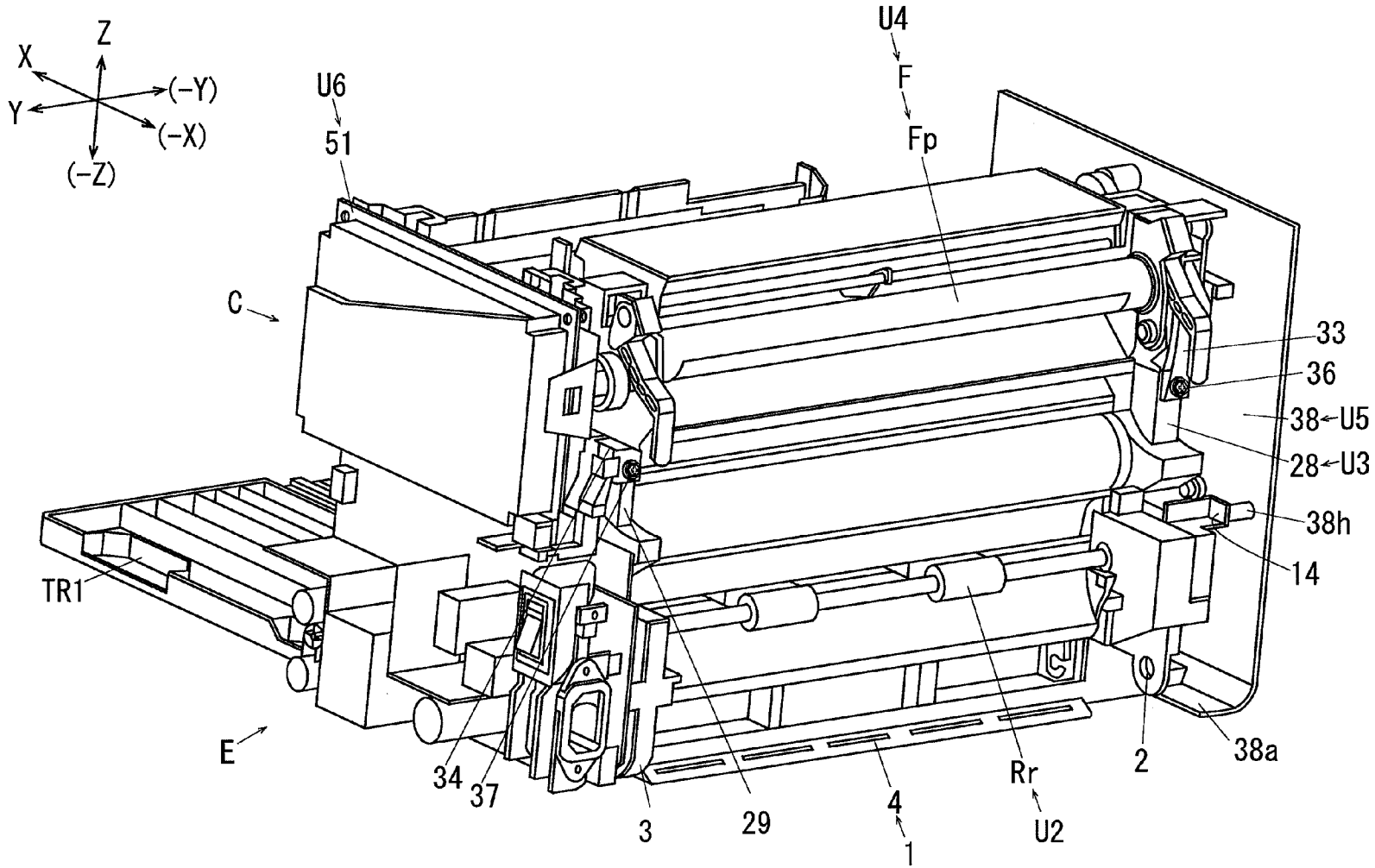
FIG. 9 is an enlarged perspective view of a circuit unit of Example 1 in a state that it is mounted on the conveying unit, the marking unit, and the fusing unit.
Figure 10:
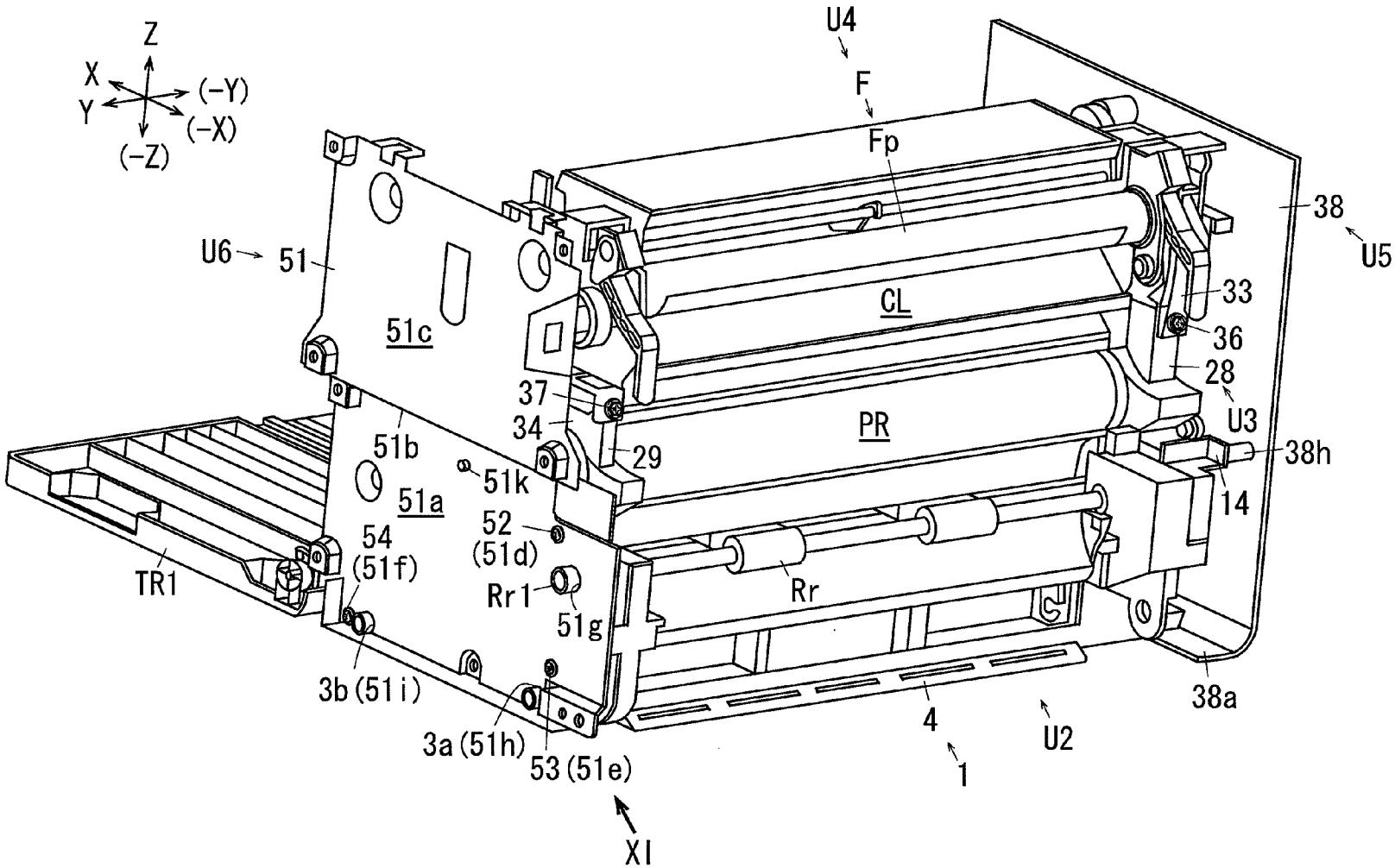
FIG. 10 is an enlarged perspective view of a circuit support body in which a power device and a controller are removed from FIG. 9.
Figure 11:
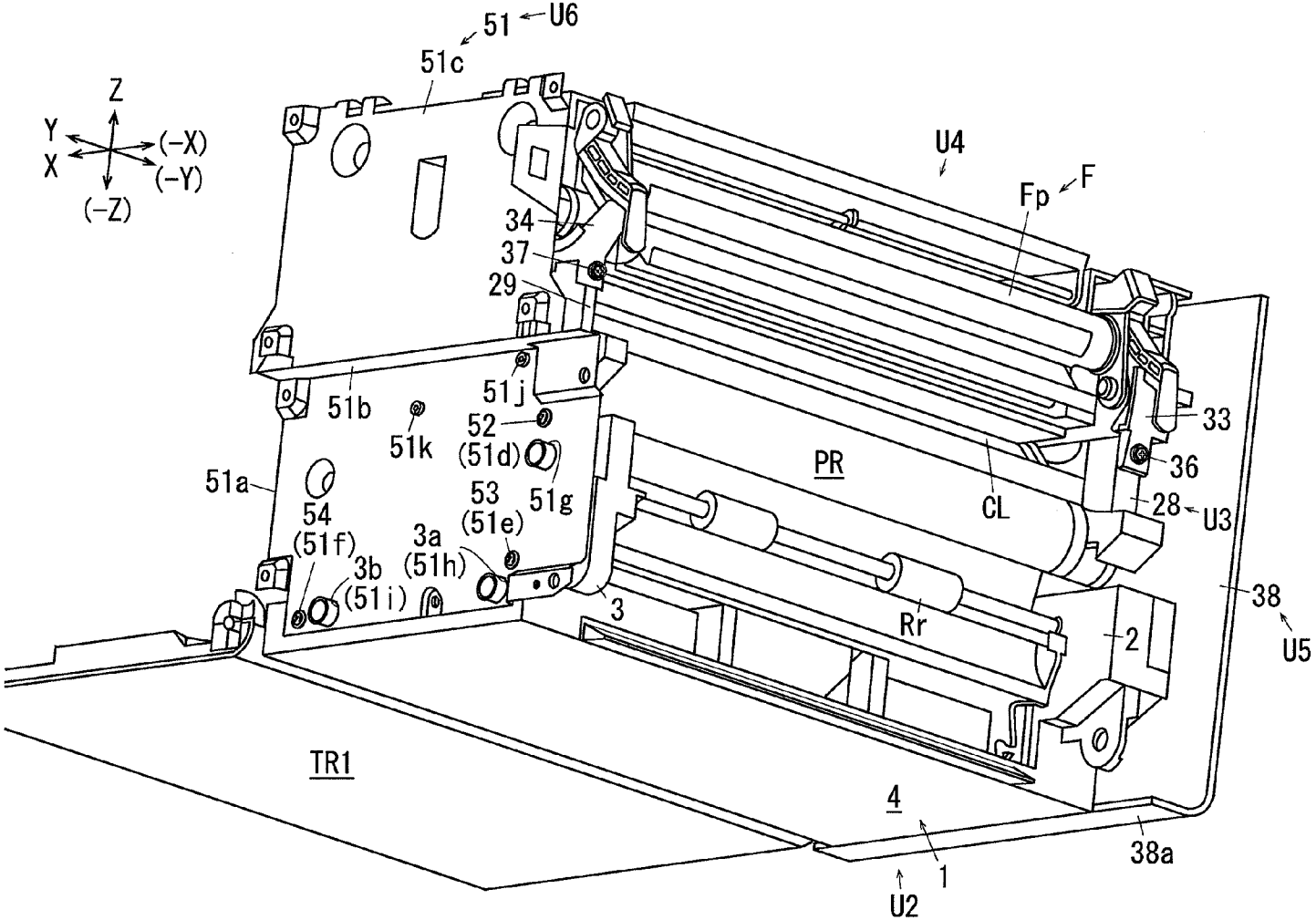
FIG. 11 is an enlarged perspective view of the circuit support body as viewed from the direction indicated by arrow XI in FIG. 10.

FIG. 9 is an enlarged perspective view of a circuit unit U6 of Example 1 in a state that it is mounted on the conveying unit U2, the marking unit U3, and the fusing unit U4. FIG. 10 is an enlarged perspective view of a circuit support body 51 in which the power device E and the controller C are removed from FIG. 9. FIG. 11 is an enlarged perspective view of the circuit support body 51 as viewed from the direction indicated by arrow XI in FIG. 10.

The circuit unit U6 in which the power device E, the controller C, etc. are supported is disposed on the right of and supported by the units U2 and U4. As shown in FIGS. 10 and 11, the circuit unit U6 has a plate-like circuit support body 51 which fully covers the right sides of the units U2-U4.

In the circuit support body 51, a flat-plate-like power source support plate 51*a* (example power source support portion) which is in contact with the right side surfaces of the units U2 and U3, a flat-plate-like connection plate 51*b* which extends rightward from the top of the power source support plate 51*a*, and a flat-plate-like control section support plate 51*c* (example control section support portion) which extends upward from the right end of the connection plate 51*b* are integrated together.

In the power source support plate 51*a* of Example 1, a first threaded hole 51*d* is formed at a top-rear position, a second threaded hole 51*e* is formed at a bottom-rear position, and a third threaded hole 51*f* is formed at a bottom-front position. A first positioning hole 51*g* through which a right end portion of a shaft member Rr1 of one of the registration rolls Rr penetrates is formed below the first threaded hole 51*d*. A second positioning hole 51*h* and a third positioning hole 51*i* are formed in the vicinities of the second threaded hole 51*e* and the third threaded hole 51*f*, respectively. Bosses 3*a* and 3*b* (example projections) which project from bottom portions, spaced from each other in the front-rear direction, of the right end wall 3 of the conveying unit U2 penetrate through the second positioning hole 51*h* and the third positioning hole 51*i*, respectively.

As shown in FIG. 11, a bearing hole 51*j* (example positioning portion) through which a right end portion of the shaft member of the photoreceptor body PR penetrates for support is formed above the first threaded hole 51*d*. As shown in FIGS. 10 and 11, a through-hole 51*k* (example second positioning portion) through which the projection 27*a* of the marking supported portion 27 penetrates is formed in front of the bearing hole 51*j*.

The circuit support body 51 of Example 1 is made of sheet metal. Therefore, the shaft member of the photoreceptor body PR of Example 1 is supported in such a state as to be positioned by the bearing hole 51*j* of the circuit support body 51 and to be able to be grounded electrically.

To attach the circuit unit U6 to the units U2-U4, first, the shaft member Rr1 of the one registration roll Rr, the bosses 3*a* and 3*b* of the right end wall 3, the shaft member of the photoreceptor body PR, and the projection 27*a* of the marking supported portion 27 of the units U2-U4 are caused to penetrate through the positioning holes 51*g*-51*i*, the bearing hole 51*j*, and the through-hole 51*k* of the circuit support body 51. Then, screws 52, 53, and 54 are screwed into the respective threaded holes 51*d*, 51*e*, and 51*f*, whereby the circuit support body 51 is fixed to the units U2-U4. Then, a power board of the power device E is caused to be supported by the right surface of the power source support plate 51*a* and a control board of the controller C is caused to be supported by the control section support plate 51*c*, whereby the unit U6 is supported by the units U2-U4.

(Workings of Example 1)

In the above-configured printer U according to Example 1, as shown in FIG. 3, the shaft member of the photoreceptor body PR is supported by the photoreceptor body support portions 6 and 7, the marking supported portions 26 and 27 are supported by the respective marking support portions 8 and 9, and the marking unit U3 is supported by the conveying unit U2 so as to be positioned over it. As shown in FIGS. 6A and 6B, the fusing supported portions 33 and 34 are supported by the rear fusing support portions 28 and 29 and the front fusing support portions 31 and 32 and prevented from coming off by screwing the screws 36 and 37 into the respective threaded holes 28*b* and 29*b*. The fusing unit U4 is thus supported by the marking unit U3 so as to be positioned over it.

As shown in FIG. 7, the link portions (38+39*h*) are linked to the conveying unit U2 by screwing screws into the respective link threaded holes 14*a* and 16*a* in a state that the nails of the two link supported portions 38*b* are fitted in the nail fixing holes 17*a* and 18*a* of the link support portions 17 and 18, respectively. The drive transmitting unit U5 is disposed on the left of and supported by the units U2-U4. As shown in FIGS. 9-11, the screws 52, 53, and 54 are screwed into the respective threaded holes 51*d*, 51*e*, and 51*f* in a state that the shaft member Rr1, the bosses 3*a* and 3*b*, the shaft member of the photoreceptor body PR, and the projection 27*a* penetrate through the respective holes 51*g*-51*k*. The circuit support member 51 is thus linked to the units U2-U4.

Then, the power device E and the controller C are attached to the thus-linked circuit support body 51 and the exterior members etc. such as the front cover U1*a* and the back cover U1*b* are attached to the units U2-U6. The printer main body U1 is thus completed.

Figure 12A:
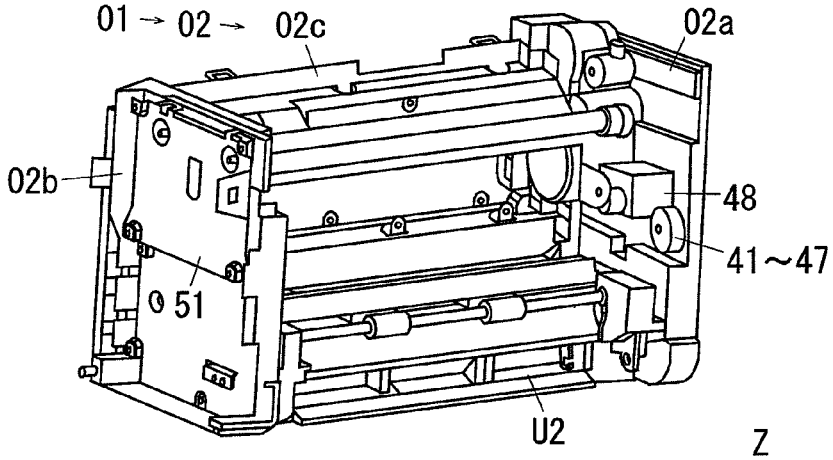
FIGS. 12A, 12B, 12C and 12D show a conventional printer main body.
Figure 12B:
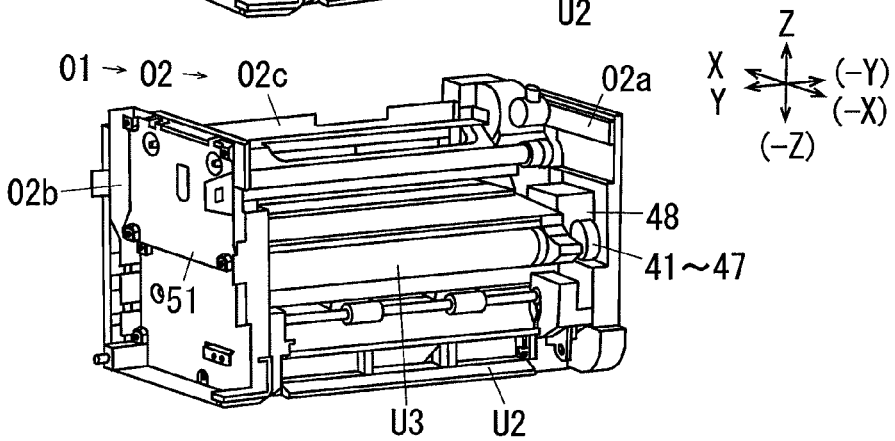
Figure 12C:
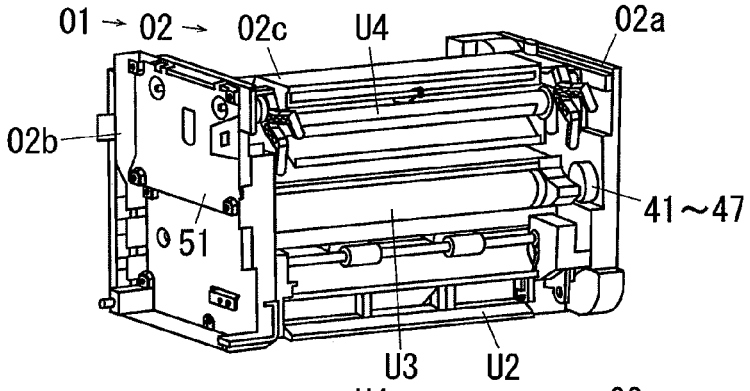
Figure 12D:
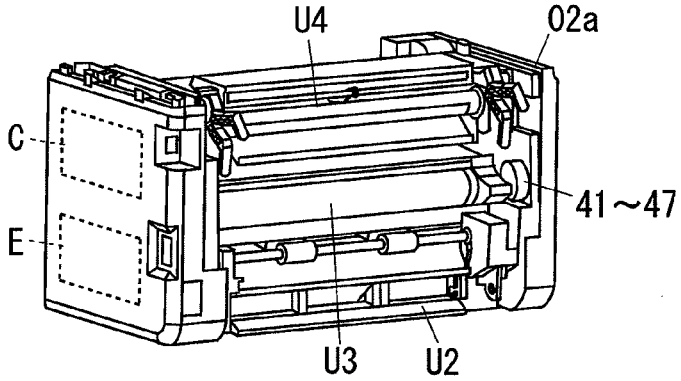

FIGS. 12A-12D show a conventional printer main body 01. More specifically, FIG. 12A shows a state that a conveying unit U2 is attached to a frame 02. FIG. 12B shows a state, following the state of FIG. 12A, that a marking unit U3 is attached to the frame 02. FIG. 12C shows a state, following the state of FIG. 12B, that a fusing unit U4 is attached to the frame 02. FIG. 12D shows a state, following the state of FIG. 12C, that a power device E, a controller C, and a cover are attached.

As shown in FIGS. 12A-12D, the conventional printer main body 01 has the frame 02 (example outer frame). As shown in FIGS. 12A-12D, the frame 02 has a left end wall 02*a* and a right end wall 02*b* and a tie bar 02*c* (example link portion) which is a top-front portion connecting the left end wall 02*a* and the right end wall 02*b*. A drive transmission system (41-47), a main motor 48, etc. which are similar to the ones used in Example 1 are supported by the right side surface of the left end wall 02*a*, and a circuit support body 51 etc. which are similar to the ones used in Example 1 are supported by the left side surface of the right end wall 02*b*. A conveying unit U2 which is similar to the one used in Example 1 are fixed to and supported by bottom portions of the left end wall 02*a* and the right end wall 02*b*.

In the conventional printer main body 01, as shown in FIGS. 12A-12D, a marking unit U3 and a fusing unit U4 which are similar to the ones used in Example 1 are supported by the frame 02 in a detachable manner and a power device E, a controller C, exterior members UI1 and U1*b*, etc. are fixed to and supported by the frame 02. That is, in the conventional printer main body 01, the units U2-U4 etc. are positioned individually and supported by the frame 02 and the frame 02 is provided with attachment/detachment guide members (guides) which enable attachment and detachment of the units U2-U4. To, for example, prevent vibration of the printer main body 01 and deformation when each of the units U2-U4 is attached or detached, the frame 02 is required to have a certain level of rigidity. Therefore, the frame 02 cannot be reduced in size, weight, or occupation space beyond certain limits (the members should be reduced in thickness and bending needs to be performed at many locations).

In contrast, in the printer main body U1 according to Example 1, the frame 02 is omitted and the units U2-U6 are attached to each other. Therefore, the printer main body 131 according to Example 1 does not require the space that is occupied by the frame 02 in the conventional printer main body 01 and hence the size of the entire apparatus is reduced accordingly. That is, the printer U according to Example 1 can be reduced in size as a whole. Furthermore, because of the omission of the frame 02, the printer U according to Example 1 is reduced in the number of components and hence the price (cost) of the entire printer U can be reduced. In the printer main body U1 according to Example 1, because of the omission of the frame 02, attachment/detachment mechanisms of the units U2-U4 are also omitted. Therefore, the drive transmitting unit U5 and the circuit unit U6 which are supported by the left side and the right side, respectively, of the units U2-U4 are not deformed when each of the units U2-U4 is attached or detached and hence are not required to be increased in rigidity.

In recent image forming apparatus, years of endurance (life) of each of such members as the photoreceptor body (PR), developing device (G), fusing device (F), charging roll (CR), transfer roll (Tr), and conveying members (Rs, Ra, Rr, and R1) have increased and the probability of occurrence of trouble such as a malfunction has decreased. As a result, the necessity of detaching one or some of the units U2-U4 and, for example, repairing it or them at the site of installation of the printer U has become low. Therefore, in the printer U according to Example 1 which is reduced in size and cost, the fact that each of the units U2-U6 cannot be detached because of the omission of the frame 02 is not very problematic.

As such, the printer U according to Example 1 is particularly suitable for use as an image forming apparatus of a low price range (what is called a low-end machine) which is required to be low in size and cost (what is called a low-end machine). For example, it is particularly suitable for use as such a low-end machine that the user is required to replace only sheets S and the toner cartridge TC and that the other members (PR, G, F, CR, Tr, Rs, Ra, Rr, and R1) are used until the end of life or it is taken back and repaired in the even of a malfunction.

In the conventional printer main body 01, the units U2-U4 are positioned and supported by the frame 02 and slight gaps are formed between the units U2-U4. As a result, in the conventional printer main body 01, if errors occur between the positions of the units U2-U4 due to, for example, insufficient accuracy of attachment of the units U2-U4, the errors between the positions of the units U2-U4 may directly result in errors between the members of the units U2-U4. In particular, there is a problem that an image deviation or the like may occur if positioning errors of the registration rolls Rr of the conveying unit U2, the fusing device F of the fusing unit U4, etc. with respect to the photoreceptor body PR of the marking unit U3 are accumulated.

In contrast, in the printer main body U1 according to Example 1, the units U2-U6 are attached to, supported by, and positioned by each other. As a result, in the printer main body U1 according to Example 1, the units U2-U6 can be positioned without forming any gaps between the units U2-U6. Unlike in the conventional printer main body 01, occurrence of errors between units U2-U6 can be prevented.

Therefore, in the printer U according to Example 1, the units U2-U6 can be positioned accurately and the conveying unit U2 and the fusing unit U4 can be positioned accurately in the top-bottom direction with the marking unit U3 as a core unit. In particular, the units U2-U4 of Example 1 are positioned on the rear side where the members PR, Rr, and F are disposed. Therefore, the positions where the units U2-U4 are positioned are close to the positions of the members PR, Rr, and F, whereby positional deviations are smaller than in a case that those two sets of positions are distant from each other. As a result, in the printer U according to Example 1, the degree of accumulation of positioning errors of the registration rolls Rr and the fusing device F with respect to the photoreceptor body PR can be reduced. The probability of occurrence of an image deviation or the like can thus be lowered.

In the printer main body U1 according to Example 1, the right end portion of the shaft member of the photoreceptor body PR is positioned in a state that it penetrates through the bearing hole 51*j* of the circuit support body 51 of the circuit unit U6 in such a manner as to be in contact with the circuit support body 51. Therefore, the photoreceptor body PR can be grounded by grounding the circuit support body 51 which is made of sheet metal. As a result, in the printer U according to Example 1, the circuit support body 51 serves as both of the positioning mechanism and the grounding mechanism for the photoreceptor body PR. The number of components can be made smaller than in a case that the circuit support body 51 is not used, which makes it possible to reduce the size and the cost of the entire printer U.

Whereas in the conventional printer main body 01 the frame 02 which is a base of the printer main body 01 is supported by the floor surface, in the printer main body U1 according to Example 1 the conveying unit U2 which is a base of the units U2-U6 is supported by the floor surface. Therefore, the printer U according to Example 1 is free of such problems as vibration and noise as long as the conveying unit U2 is sufficiently rigid and is supported by the floor surface stably. Even if the conveying unit U2 is not supported by the floor stably (e.g., the floor surface is not stable), the probability of occurrence of an image deviation or the like can be reduced because the units U3-U6 incline following inclination of the conveying unit U2.

Example 2

Next, Example 2 of the invention will be described. In the following description of Example 2, constituent elements having corresponding ones in Example 1 will be given the same reference symbols as the latter and will not be described in detail. Example 2 is the same as Example 1 except for features described below.

Figure 13:
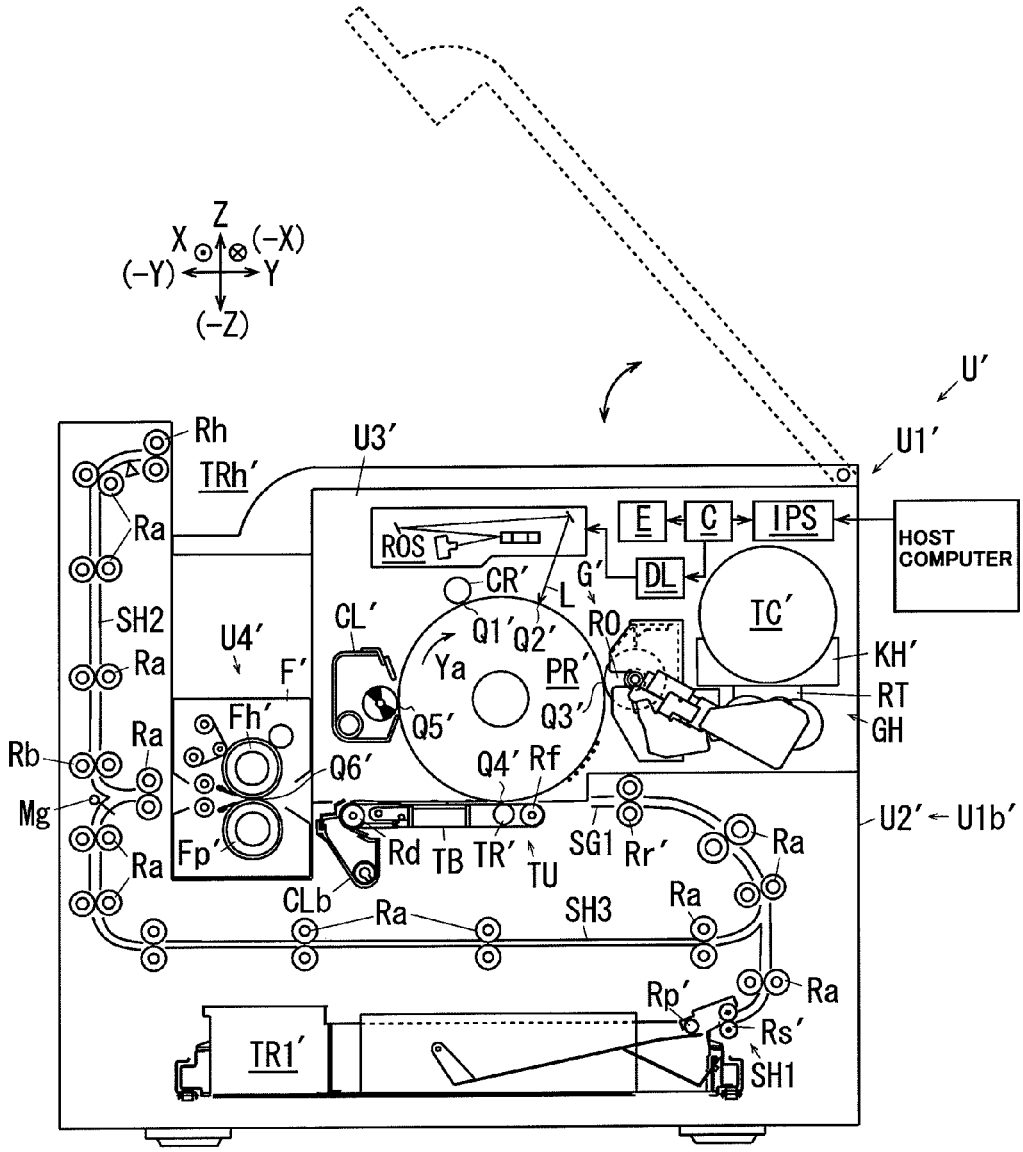
FIG. 13 shows the whole of a printer according to Example 2.

FIG. 13 shows the whole of a printer U' according to Example 2. As shown in FIG. 13, a printer main body U1' of the printer U' has a controller C, a power device E, an image processing system IPS, and a laser drive circuit DL which are similar to the controller C, power device E, image processing system IPS, and laser drive circuit DL used in Example 1. The laser drive circuit DL of Example 2 outputs an image writing light drive signal that corresponds to input image data to an exposing device ROS rather than the latent image forming device LH which is used in Example 1. A photoreceptor body PR' (example image holding body) which is disposed under the exposing device ROS is rotated in the direction indicated by arrow Ya. The surface of the photoreceptor body PR' is charged by a charging roll CR' (example charger) at a charging region Q1' and then exposure-scanned by a laser beam L (example latent image writing light) coming from the exposing device ROS at a latent image forming position Q2', whereby an electrostatic latent image is formed thereon. As the photoreceptor body PR' is rotated, its surface on which the electrostatic latent image is formed passes a developing region Q3' and a transfer region Q4' (example image recording region) in order.

A developing device H' for developing such an electrostatic latent image at the developing region Q3' transports a developer containing a toner and a carrier to the developing region Q3' by means of a developing roll R0 (example developer holding body) and develops the electrostatic latent image passing the developing region Q3' into a toner image (example image). The toner image formed on the surface of the photoreceptor body PR' is carried to the transfer region Q4'.

A toner cartridge TC' (example developer supply container) for supplying developer to make up for developer that has been consumed by the developing device G' is attached to a cartridge holder KH' (example mounting unit) in a detachable manner. Developer supplied from the toner cartridge TC' is transported in a reserve tank RT (example developer container) while being stirred and transported to the developing device G' by a developer transport device GH which is disposed in the reserve tank RT.

A transfer unit TU (example transfer conveying device) which is opposed to the photoreceptor body PR' at the transfer region Q4' has a transfer belt TB (example lower guide member, example medium conveying member). The transfer belt TB is supported rotatably by belt support rolls (Rd+Rf) (an example medium conveying member support system), that is, a drive roll Rd (example drive member) and a follower roll Rf (example follower member). A transfer roll Tr' (example transfer device) is opposed to the photoreceptor body PR' with the transfer belt TB interposed in between. A peeling nail SC (example medium peeling member) is opposed to the drive roll Rd, and a belt cleaner CLb (example medium conveying member cleaner) is disposed downstream of the peeling nail SC in the rotation direction of the transfer belt TB.

The transfer roll Tr' is a member for transferring a toner image formed on the surface of the photoreceptor body PR' to a sheet S (example medium), and is supplied with a transfer voltage whose polarity is opposite to the charging polarity of the development toner used in the developing device G'.

A sheet S that has been housed in a sheet supply tray TR1' (example medium housing member) is conveyed to the transfer region Q4' along a sheet supply path SH1 (example medium conveyance path). More specifically, sheets S housed in the sheet supply tray TR1' are picked up by a pickup roll Rp' (example medium pickup member) with prescribed timing and separated into individual sheets S by a separation roll Rs' (example medium separating member), and each sheet S is conveyed to registration rolls Rr' (example conveyance adjusting members) by conveying rolls Ra (example pairs of medium conveying members). In Example 2, the registration rolls Rr' are disposed below the developing device G' and on the right of the photoreceptor body PR', that is, below the developing region Q3' and on the right of the transfer region Q4'. That is, the vertical position where the pair of (top and bottom) registration rolls Rr' are in pressure contact with each other is set the same as the vertical position of the transfer region Q4' in advance, and the printer main body U1' is designed so that a sheet S that is conveyed from the registration rolls Rr' is then conveyed horizontally to the transfer region Q4'.

The sheet S that has been conveyed to the registration rolls Rr' is conveyed from a pre-transfer sheet guide SG1 (example pre-transfer medium guide member) to the transfer belt TB of the transfer unit TU so as to be timed with movement to the transfer region Q4' of the toner image formed on the photoreceptor body PR'. The transfer belt TB conveys the received sheet S to the transfer region Q4'.

The developed toner image on the surface of the photoreceptor body PR' is transferred to the sheet Sat the transfer region Q4' by the transfer roll Tr'. Residual toner is removed from the surface of the photoreceptor body PR' by a photoreceptor body cleaner CL' (example image holding body cleaner) at a cleaning region Q5' (example cleaning region) which is downstream of the transfer region Q4' in the rotation direction indicated by arrow Ya. Then, the surface of the photoreceptor body PR' is charged again by the charging roll CR.

The photoreceptor body PR', the developing device G', and the transfer roll Tr' constitute an image recording device (PR'+G'+Tr').

The sheet S to which the toner image has been transferred by the transfer roll Tr' at the transfer region Q4' is peeled from the surface of the transfer belt TB by the peeling nail SC which is disposed downstream of the transfer region Q4'. The toner image on the peeled sheet S is heat-fused by a fusing device F' which has a heating roll Fh' (example heat fusing member) and a pressure roll Fp' (example pressure fusing member).

The fusing device F' of Example 2 is disposed on the left of the photoreceptor body PR', and a fusing region Q6' which is formed by the pair of fusing rolls Fh' and Fp' is located on the left of the transfer region Q4'. That is, the vertical position where the fusing position Q6' is set the same as that of the transfer region Q4' in advance, and the printer main body U1' is designed so that a sheet S that is conveyed from the transfer belt TB is then conveyed horizontally to the fusing region Q6'.

The heat-fused sheet S passes through a Mylar gate MG (example conveyance path switching member) made of an elastic sheet and then transferred to normal/reverse-rotatable conveying rolls Rb of a sheet ejection path SH2 (example medium ejection path). Deformed elastically, the Mylar gate MG directs the sheet S that has passed the fusing device F' to the sheet ejection path SH2.

The sheet S to be ejected to an ejected sheet tray TRh' (example ejected sheet storage unit) which is part of a top wall of the printer main body U1' is conveyed along the upward extending sheet ejection path SH2 in which the normal/reverse-rotatable conveying rolls Rb and plural pairs of conveying rolls Ra are arranged in the top-bottom direction. Then, the sheet S is ejected to the ejected sheet tray TRh' by sheet ejecting rolls R1' (example medium ejecting members). That is, in Example 2, a sheet S is conveyed upward from the right end of the sheet supply tray TR1' which is disposed at the bottom of the printer main body U1' along the sheet supply path SH1, then conveyed leftward horizontally, then conveyed vertically along the sheet ejection path SH2, and finally ejected to the ejected sheet tray TRh' from its left end. As such, as shown in FIG. 13, the printer U' according to Example 2 is configured in such a manner that the conveyance path of a sheet S has an S-shape (the conveyance path is what is called an S path).

To expose the inside of the printer main body U1' in, for example, checking for a sheet jam or inspecting the inside, the ejected sheet tray TRh' of Example 2 is supported so as to be rotatable between a closed position (indicated by a solid line) and an open position (indicated by a broken line).

When a one-surface-recorded sheet S for double-sided printing is conveyed to the normal/reverse-rotatable conveying rolls Rb, the normal/reverse-rotatable conveying rolls Rb are rotated reversely immediately before passage of the tail of the one-surface-recorded sheet S, whereby the one-surface-recorded sheet S is conveyed downward (in the reverse sheet conveyance direction) along the sheet ejection path SH2 (i.e., switched back). The Mylar gate directs the sheet S that has been switched back from the conveying rolls Rb to a sheet circulatory conveyance path SH3 (example medium circulatory conveyance path). The one-surface-recorded sheet S that has been conveyed to the sheet circulatory conveyance path SH3 is again supplied to the transfer region Q4' in a flipped state. A second toner image is transferred, at the transfer region Q4', to the one-surface-recorded sheet S that has been supplied there again.

The constituent elements SH1-SH3, Rp', Rs', Rr', Ra, Rb, R1', MG, etc. constitute a medium conveying device SU of Example 2.

(Conveying Unit U2' of Example 2)

Figure 14A:
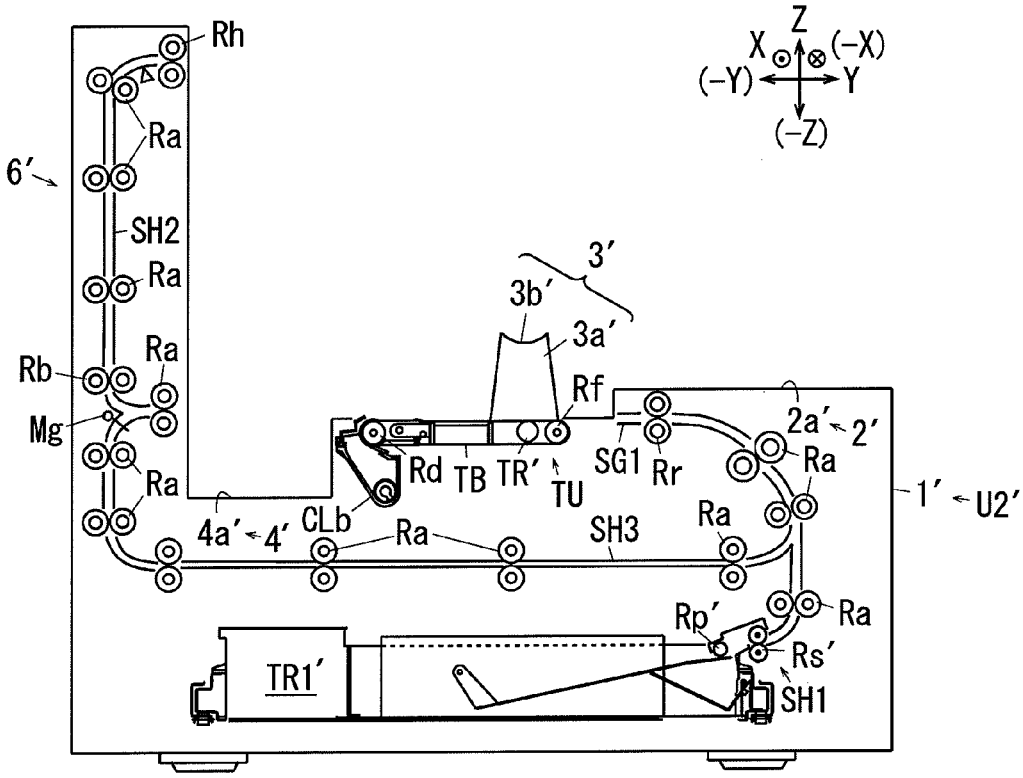
FIGS. 14A, 14B and 14C show a conveying unit U2', a marking unit U3', and a fusing unit U4' of Example 2, respectively.
Figure 14B:
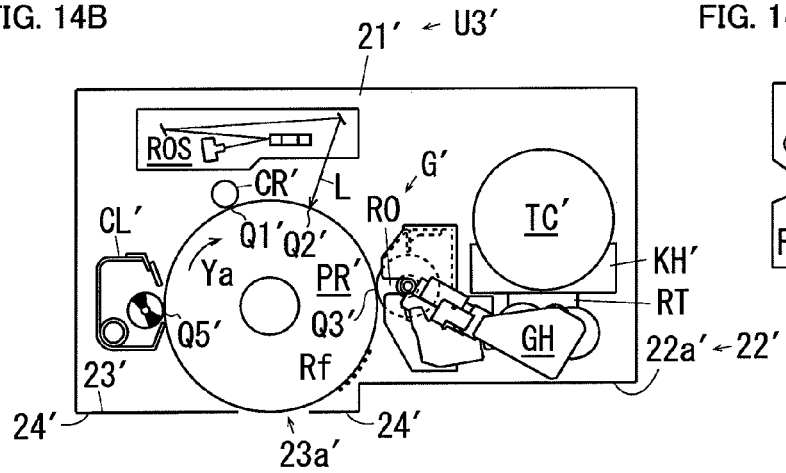
Figure 14C:
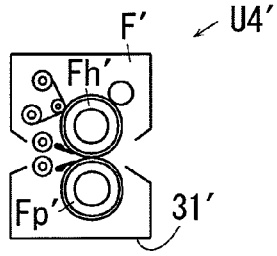

FIGS. 14A-14C show a marking unit U3', and a fusing unit U4' of Example 2, respectively.

The conveying unit U2' which supports the members TR1', Rp', Rs', Rr', SG1, TU, Mg, Ra, Rb, etc. for conveying a sheet S is provided in the printer U1' according to Example 2. As shown in FIG. 14A, the conveying unit U2' of Example 2 has a conveyance housing 1' (example conveyance support body) which supports the members TR1', Rp', Rs', Rr', SG1, TU, Mg, Ra, Rb, etc.

The conveyance housing 1' of Example 2 is configured in such a manner that its height decreases stepwise as the position goes leftward in order of a right end portion 2', a right-hand central portion 3', and a left-hand central portion 4' and is largest at a left end portion 6'. In Example 2, the registration rolls Rr and the pre-transfer sheet guide SG1 are provided inside a top portion of the right end portion 2' and the top surface of the right end portion 2' serves as a flat marking support portion 2*a*' (example first support portion).

In Example 2, the transfer unit TU is provided inside a top portion of the right-hand central portion 3' and the top surface of the transfer belt TB is exposed as part of the top surface of the right-hand central portion 3'.

A pair of (front and rear) photoreceptor body support portions 3*a*' (example image holding body support portions) project upward from the tops of front and rear end walls of the right-hand central portion 3' and hence are located above the transfer roll Tr'. In Example 2, top portions of the photoreceptor body support portions 3*a*' are formed with respective bearing portions 3*b*' for the shaft member of the photoreceptor body PR'.

In Example 2, the top surface of the left-hand central portion 4' serves as a flat fusing support portion 4*a*' (example second support portion). In Example 2, the members Ra, Rb, R1', MG, etc. which are provided in the vertically extending sheet ejection path SH2 are supported inside the left end portion 6'.

(Marking Unit U3' of Example 2)

The marking unit U3' (example image holding body unit) which support the photoreceptor body PR', the photoreceptor body cleaner CL', the charging roll CR', the exposing device ROS, the developing device G', etc. is supported by the right end portion 2' of the conveying unit U2'. As shown in FIG. 14B, the marking unit U3' has a marking housing 21' (example image holding support body) which supports the members PR', CL', CR', ROS, and G'. The making housing 21' of Example 2 has a step so that a right bottom wall 22' which is located under the developing device G is higher than a left bottom wall 23' which is located under the photoreceptor body PR' and the photoreceptor body cleaner CL'.

In Example 2, the bottom surface of the right bottom wall 22' serves as a flat marking supported portion 22*a*' (example first supported portion). The left bottom wall 23' is formed, approximately at the center in the right-left direction, with an opening 23*a*' through which a bottom portion of the photoreceptor body PR' is exposed. And flat upper guides 24' (example upper guide members) are supported by the bottom surface of the left bottom wall 23' so as to be opposed to the top surface of the transfer belt TB with a gap, to extend in the horizontal direction parallel with each other, and to guide the top surface of a sheet S conveyed from the registration rolls Rr to the transfer belt TB.

The transfer belt TB and the top guides 24' constitute guide members (TB+24') of Example 2.

In Example 2, the shaft member of the photoreceptor body PR' is positioned and supported in a state that it is fitted in the bearing portions 3*b*' of the two photoreceptor body support portions 3*a*'. At this time, the marking supported portion 22*a*' is supported by the marking support portion 2*a*', whereby the marking unit U3' is supported by the conveying unit U2' so as to be positioned over it.

(Fusing Unit U4' of Example 2)

The fusing unit U4' is supported by the left-hand central portion 4' so as to be located adjacent to the marking unit U3'. As shown in FIG. 14C, the fusing unit U4' has the fusing device F' and a fusing supported portion 31' (example second supported portion) which is formed in the bottom surface of the fusing device F'.

In Example 2, settings are made in advance so that the fusing device F' is fitted in the conveying unit U2' (between its right-hand central portion 3' and left end portion 6') and the fusing supported portion 31' is supported by the fusing support portion 4*a*'. That is, in Example 2, the fusing supported portion 31' is supported by the fusing support portion 4*a*', whereby the fusing unit U4' is supported by the conveying unit U2' so as to be positioned over it.

(Workings of Example 2)

In the above-configured printer U' according to Example 2, as shown in FIG. 13, the shaft member of the photoreceptor body PR' is supported by the bearing portions 3*b*' of the photoreceptor body support portions 3*a*'. And the marking supported portion 22*a*' is supported by the marking support portion 2*a*', whereby the marking unit U3' (see FIG. 14B) is supported by the conveying unit U2' (see FIG. 14A) so as to be positioned over it. The fusing supported portion 31' is supported by the fusing support portion 4*a*' in a state that the fusing device F' is sandwiched between the right-hand central portion 3' and the left end portion 6', whereby the fusing unit U4' (see FIG. 14C) is supported by the conveying unit U2' so as to be positioned over it.

Then, in the printer U' according to Example 2, as in the printer U according to Example 1, a drive transmitting unit, a circuit unit, exterior members, etc. (none of which are shown) are attached to the units U2'-U4'. The printer main body U1' is thus completed.

Therefore, in the printer U' according to Example 2, as in the printer U according to Example 1, because of the omission of the frame 02 shown in FIGS. 12A-12D, the size of the entire printer U' and the number of components can be made smaller than in the conventional printer main body 01 having the frame 02 and hence the cost of the entire printer U' can be reduced.

In the printer main body U1' according to Example 2, because of the omission of the frame 02, the units U2'-U4' can be positioned with respect to each other directly, that is, without intervention of a frame. As a result, in the printer U' according to Example 2, occurrence of errors between the units U2'-U4' can be prevented unlike in the conventional printer main body 01 and hence the units U2'-U4' can be positioned accurately.

Whereas in the printer U according to Example 1 the conveying unit U2 and the fusing unit U4 are positioned in the top-bottom direction with the marking unit U3 as a core unit, in the printer U' according to Example 2 the marking unit U3' and the fusing unit U4 are positioned relative to each other via the conveying unit U2'.

In the printer U' according to Example 2, the members PR', Rr', and F' are arranged in the horizontal direction and a sheet S conveyed from the registration rolls Rr' passes the transfer region Q4' and the fusing region Q6' while being conveyed in the horizontal direction by the guide members (TB+24'). That is, a sheet S conveyed from the registration rolls Rr' passes between the marking unit U3' located above and the conveying unit U2' located below while being guided so as to move leftward (i.e., in the sheet conveyance direction).

That is, in the printer U' according to Example 2, the conveyance path is formed by utilizing the boundary space between the marking unit U3' and the conveying unit U2' instead of forming a conveyance path inside the units U2' and U3'.

In the other respects, the printer U' according to Example 2 works in the same manners and provides the same advantages as the printer U according to Example 1.

MODIFICATIONS

Although Examples of the invention have been described above in detail, the invention is not limited to those Examples and various modifications are possible without departing from the spirit and scope of the invention as described in the claims. Example modifications (H01)-(H07) to Examples will be described below.

(H01) Although Examples are directed to the printers U and U' as example image forming apparatus, the invention is not limited to such a case and can also be applied to a multifunction machine having all or plural ones of the printing, facsimile, and copying functions. The application range of the invention is not limited to monochrome image forming apparatus and includes color image forming apparatus.

(H02) Although the printers U and U' according to Examples are such that cut sheets S are taken out one by one, the invention is not limited to such a case and can also be applied to image forming apparatus which use, for example, a continuous sheet having feed holes or a pinless continuous sheet.

(H03) In the printer U according to Example 1, the fusing unit U4 is supported in a state that it is positioned by the marking unit U3. In the printer U' according to Example 2, the fusing unit U4' is supported in a state that it is positioned by the conveying unit U2'. However, the invention is not limited to such cases. For example, configurations are possible in which the fusing units U4 and U4' are supported by the drive transmitting unit U5 or the circuit unit U6.

(H04) In the printer U according to Example 1, the transfer roll Tr is supported on the side of the back cover U1*b*. In the printer U' according to Example 2, the transfer unit TU having the transfer roll Tr' is supported by the conveying unit U2'. However, the invention is not limited to such cases. For example, a configuration is possible in which the transfer roll Tr or the transfer unit TU is supported by the marking unit U3 or U3'. In this case, a conveyance path passing through the transfer region Q4 or Q4' is formed inside the marking unit U3 or U3'.

(H05) Although in Examples the main motor 48 is supported by the drive transmitting unit U5, the invention is not limited to such a case. For example, a configuration is possible in which the main motor 48 is supported by one of the conveying unit U2 or U2', the marking unit U3 or U3', and the fusing unit U4 or U4'.

(H06) It is preferable that as in Examples the circuit support body 51 which is made of sheet metal serve as both of the positioning mechanism and the grounding mechanism for the photoreceptor body PR to reduce the number of components. However, the invention is not limited to the case that the circuit support body 51 is made of sheet metal. For example, a configuration is possible in which the circuit support body 51 serves as only the positioning mechanism for the photoreceptor body PR and a separate sheet metal member for grounding the photoreceptor body PR is used.

(H07) It is preferable that as in Example 2 the conveyance path that relate to the members PR', Rr', and F' of the units U2'-U4' extend in the horizontal direction. However, the invention is not limited to such a case. A configuration is possible in which the members PR', Rr', and F' are arranged so that the corresponding conveyance path is curved.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a fusing unit that includes a fusing portion fusing a medium on which an image is formed, and pluralities of fusing unit supported portions;

an image forming unit that is disposed below the fusing unit and includes pluralities of image forming unit supported portions, pluralities of fusing unit supporting portions supporting the fusing unit by receiving and supporting the pluralities of fusing unit supported portions, and an image holding body rotated while holding the image on a surface of the image holding body, the image holding body forming the image on the medium and sending the medium to the fusing unit; and a conveying unit that is disposed below the image forming unit and includes conveying members conveying the medium to the image forming unit, and pluralities of image forming unit supporting portions supporting the image forming unit by receiving and supporting the pluralities of image forming unit supported portions;

wherein shapes of the pluralities of fusing unit supporting portions are different from shapes of the pluralities of image forming unit supporting portions.

2. The image forming apparatus according to claim 1, wherein the pluralities of image forming unit supporting portions have different shapes.

3. The image forming apparatus according to claim 1, wherein the fusing unit is supported by the pluralities of fusing unit supporting portions of the image forming unit without being supported by an image forming apparatus supporting frame used to support units inside the image forming apparatus.

4. The image forming apparatus according to claim 1, wherein the image forming unit is supported by the pluralities of image forming unit supporting portions of the conveying unit without being supported by an image forming apparatus supporting frame used to support units inside the image forming apparatus.

5. The image forming apparatus according to claim 1, further comprising:

a transfer device opposed to the image holding body with a transfer position where to transfer an image to the medium interposed in between, for transferring the image formed on the surface of the image holding body to the medium.

6. The image forming apparatus according to claim 5, further comprising a drive transmitting unit comprising a link portion that is disposed on a side of one end of the image holding body in its axial direction and connected to the image holding body unit, the conveying unit, and the fusing unit and a drive transmission system for transmitting drive power from a drive source to the connected image holding body unit, conveying unit, and fusing unit.

7. The image forming apparatus according to claim 6, further comprising the drive source supported by one of the image holding body unit, the conveying unit, the fusing unit, and the drive transmitting unit, for generating the drive power to be supplied to the drive transmission system.

8. The image forming apparatus according to claim 7, wherein the image holding body unit comprises a positioned portion, the image forming apparatus further comprising:

a circuit support body disposed on a side of the other end of the image holding body in its axial direction and comprising a power source support portion that supports a power source for the individual units, a control section support portion that supports a control section for controlling the individual units, and a positioning portion that positions the positioned portion.

9. The image forming apparatus according to claim 8, wherein the positioned portion is part of a shaft member of the image holding body; and the positioning portion can electrically ground the positioned portion and supports and positions the positioned portion.

10. The image forming apparatus according to claim 6, wherein the image holding body unit comprises a positioned portion, the image forming apparatus further comprising:

a circuit support body disposed on a side of the other end of the image holding body in its axial direction and comprising a power source support portion that supports a power source for the individual units, a control section support portion that supports a control section for controlling the individual units, and a positioning portion that positions the positioned portion.

11. The image forming apparatus according to claim 10, wherein the positioned portion is part of a shaft member of the image holding body; and the positioning portion can electrically ground the positioned portion and supports and positions the positioned portion.

12. The image forming apparatus according to claim 1, further comprising:

a transfer device opposed to the image holding body with a transfer region where to transfer an image to the medium interposed in between, for transferring the image formed on the surface of the image holding body to the medium; and guide members having an upper guide member that is provided in a bottom surface of the image holding body unit and a lower guide member that is provided in a top surface of the conveying unit and opposed to the upper guide member, for guiding the medium conveyed from the conveying unit as the medium is conveyed along a conveyance path formed between the upper guide member and the lower guide member.

13. The image forming apparatus according to claim 12, further comprising:

a drive transmitting unit comprising a link portion that is disposed on a side of one end of the image holding body in its axial direction and connected to the image holding body unit, the conveying unit, and the fusing unit and a drive transmission system for transmitting drive power from a drive source to the connected image holding body unit, conveying unit, and fusing unit.

14. The image forming apparatus according to claim 13, further comprising the drive source supported by one of the image holding body unit, the conveying unit, the fusing unit, and the drive transmitting unit, for generating the drive power to be supplied to the drive transmission system.

15. The image forming apparatus according to claim 14, wherein the image holding body unit comprises a positioned portion, the image forming apparatus further comprising:

a circuit support body disposed on a side of the other end of the image holding body in its axial direction and comprising a power source support portion that supports a power source for the individual units, a control section support port that supports a control section for controlling the individual units, and a positioning portion that positions the positioned portion.

16. The image forming apparatus according to claim 15, wherein the positioned portion is part of a shaft member of the image holding body; and the positioning portion can electrically ground the positioned portion and supports and positions the positioned portion.

17. The image forming apparatus according to claim 13, wherein the image holding body unit comprises a positioned portion, the image forming apparatus further comprising:

a circuit support body disposed on the side of the other end of the image holding body in its axial direction and comprising a power source support portion that, supports a power source for the individual units, a control section support portion that supports a control section for controlling the individual units, and a positioning portion that positions the positioned portion.

18. The image forming apparatus according to claim 17, wherein the positioned portion is part of a shaft member of the image holding body; and the positioning portion can electrically ground the positioned portion and supports and positions the positioned portion.

* * * * *